US010087643B2

(12) United States Patent
Lubberts

(10) Patent No.: US 10,087,643 B2
(45) Date of Patent: Oct. 2, 2018

(54) BUILDING SYSTEMS AND METHODS

(71) Applicant: Matthew John Lubberts, Kitchener (CA)

(72) Inventor: Matthew John Lubberts, Kitchener (CA)

( * ) Notice: Subject to any disclaimer, the term of this patent is extended or adjusted under 35 U.S.C. 154(b) by 0 days.

(21) Appl. No.: 15/446,519

(22) Filed: Mar. 1, 2017

(65) Prior Publication Data

US 2017/0175408 A1 Jun. 22, 2017

Related U.S. Application Data

(62) Division of application No. 14/434,974, filed as application No. PCT/CA2013/050786 on Oct. 17, 2013.

(Continued)

(51) Int. Cl.

| | |
|---|---|
| ***E04B 1/00*** | (2006.01) |
| ***E04G 21/14*** | (2006.01) |
| ***E04B 1/343*** | (2006.01) |
| ***E04B 1/38*** | (2006.01) |
| ***E04B 1/41*** | (2006.01) |

(Continued)

(52) U.S. Cl.

CPC ..... *E04G 21/147* (2013.01); *E02D 31/04* (2013.01); *E04B 1/34321* (2013.01); *E04B 1/383* (2013.01); *E04B 1/4107* (2013.01); *E04B 1/4178* (2013.01); *E04B 1/6801* (2013.01); *E04C 2/044* (2013.01); *E04C 2/46* (2013.01); *E04B 2001/405* (2013.01); *E04B 2001/4192* (2013.01)

(58) Field of Classification Search

CPC ..... E04G 21/147; E02D 31/04; E04C 2/46; E04C 2/044; E04B 1/383; E04B 1/4107; E04B 1/6801; E04B 1/4178; E04B 1/34321; E04B 2001/4192; E04B 2001/405

USPC ..... 52/281, 309.11, 309.12, 414, 251

See application file for complete search history.

(56) References Cited

U.S. PATENT DOCUMENTS

| | | | | |
|---|---|---|---|---|
| 889,083 A | | 5/1908 | Aiken | |
| 3,503,165 A | * | 3/1970 | Hardt | E04C 2/044 52/125.5 |

(Continued)

FOREIGN PATENT DOCUMENTS

| | | |
|---|---|---|
| WO | 2004/101905 A1 | 11/2004 |
| WO | 2014/059546 A1 | 4/2014 |

OTHER PUBLICATIONS

International Preliminary Report on Patentability dated Apr. 21, 2015 in respect of International Application No. PCT/CA2013/050786.

(Continued)

*Primary Examiner* — Basil S Katcheves
*Assistant Examiner* — Joshua K Ihezie
(74) *Attorney, Agent, or Firm* — Bereskin & Parr LLP/S.E.N.C.R.L., s.r.l.

(57) ABSTRACT

A plurality of panel subassemblies are used to erect a building on a footing or foundation. Each panel subassembly includes at least one column formed of a thermally-insulating material, and a concrete portion at least partially attached to the at least one column. The concrete portion may be formed as a single precast unit. The panel subassemblies are secured together and to the foundation, and may be secured to a floor element of the building to at least partially support the floor element.

20 Claims, 20 Drawing Sheets

Related U.S. Application Data

(60) Provisional application No. 61/714,833, filed on Oct. 17, 2012.

(51) Int. Cl.

| | |
|---|---|
| ***E04B 1/68*** | (2006.01) |
| ***E02D 31/04*** | (2006.01) |
| ***E04C 2/04*** | (2006.01) |
| ***E04B 2/00*** | (2006.01) |

(56) References Cited

U.S. PATENT DOCUMENTS 3,678,638 A 7/1972 Mougin
4,038,798 A 8/1977 Sachs
4,275,538 A * 6/1981 Bounds ..... E02D 27/32 126/617
4,291,513 A * 9/1981 Ankarswed ..... E04C 2/044 52/284
4,319,440 A * 3/1982 Rassias ..... E04B 2/52 52/438
4,486,993 A * 12/1984 Graham ..... E04B 1/76 52/223.7
4,669,240 A * 6/1987 Amormino ..... E04B 1/04 264/253
4,823,534 A 4/1989 Hebinck
5,119,606 A * 6/1992 Graham ..... E04C 2/044 52/125.4
5,193,320 A * 3/1993 Coccagna ..... E04B 2/10 52/308
5,465,542 A 11/1995 Terry
5,535,556 A * 7/1996 Hughes, Jr. ..... E04B 1/0007 405/229
5,678,384 A * 10/1997 Maze ..... E04B 1/14 292/36
5,709,061 A * 1/1998 Dietrich ..... E04B 1/7604 52/405.1
5,729,936 A * 3/1998 Maxwell ..... E04C 2/16 52/220.2
5,809,712 A 9/1998 Simanjuntak
6,003,278 A * 12/1999 Weaver ..... E04C 2/044 249/26
6,151,843 A 11/2000 Weaver et al.
6,260,320 B1 * 7/2001 Di Lorenzo ..... E04B 1/04 52/250
6,280,669 B2 * 8/2001 Kistner ..... E04C 2/044 264/135
6,463,702 B1 * 10/2002 Weaver ..... E04B 1/04 52/236.9
6,698,150 B1 * 3/2004 DiLorenzo ..... E01F 8/0029 52/250
7,832,174 B2 * 11/2010 Way ..... E04B 1/163 52/236.6
7,900,410 B2 * 3/2011 Skendzic ..... E04B 1/04 52/236.5
8,011,147 B2 * 9/2011 Hanlan ..... E04B 1/20 52/236.3
8,375,677 B1 * 2/2013 Weiler ..... E04B 1/0007 52/319
2002/0041796 A1 * 4/2002 Greenberg ..... E02D 29/0283 405/284
2006/0254167 A1 * 11/2006 Antonic ..... E04B 1/28 52/293.3
2009/0272053 A1 * 11/2009 Dent ..... E02D 27/32 52/296
2009/0308011 A1 12/2009 Philippe
2010/0054859 A1 * 3/2010 He ..... E02D 5/14 405/36
2010/0058700 A1 * 3/2010 LeBlang ..... E04B 1/165 52/506.05
2010/0251645 A1 10/2010 Philippe
2011/0126484 A1 * 6/2011 Carrion ..... E04B 1/04 52/426
2015/0089891 A1 * 4/2015 Schiffmann ..... E02D 27/013 52/309.1
2015/0275499 A1 10/2015 Lubberts

OTHER PUBLICATIONS

Office Action and related documents dated Sep. 28, 2015 in respect of U.S. Appl. No. 14/434,974.
Office Action and related documents dated Apr. 20, 2016 in respect of U.S. Appl. No. 14/434,974.

* cited by examiner

BUILDING SYSTEMS AND METHODS

CROSS-REFERENCE TO RELATED APPLICATIONS

This is a divisional application of U.S. application Ser. No. 14/434,974 filed on Apr. 10, 2015, which is a national stage application of International Application No. PCT/CA2013/050786 filed on Oct. 17, 2013, which claims priority to U.S. Provisional Application No. 61/714,833 filed on Oct. 17, 2012, and the entire contents of each are hereby incorporated herein by reference.

FIELD

The present disclosure relates to building systems in which loadbearing panels may be secured together relatively quickly. The present disclosure also relates to methods of forming the panels, and methods of assembling the panels to form the building systems.

BACKGROUND

Numerous types of buildings are known, in which various elements are fastened together in various ways. Although the known building construction arrangements have different advantages relative to each other, the known building construction arrangements also have a number of disadvantages, one of which is the time required to be spent in constructing the building. For example, in general, constructing a relatively small multi-storey building typically would require several weeks, depending on the building and the method of construction used.

INTRODUCTION

The following paragraphs are intended to introduce the reader to the more detailed description that follows and not to define or limit the claimed subject matter.

According to an aspect of the present disclosure, a system for erecting a building on a foundation is provided, the system including: a plurality of panel subassemblies, each panel subassembly including at least one column including a thermally-insulating material, and a concrete portion at least partially attached to the at least one column; and a mechanism for securing at least one of the panel subassemblies to the foundation.

The concrete portion of each panel subassembly may include upper and lower concrete beams. The concrete portion of each panel subassembly may include at least one horizontal rebar element in each of the upper and lower concrete beams. The concrete portion of each panel subassembly may include at least one concrete column. The concrete portion of each panel subassembly may include at least one vertical rebar element in the at least one concrete column.

The concrete portion of each panel subassembly may include a concrete exterior layer. The concrete portion of each panel subassembly may be formed in a single precast unit. The at least one column of each panel subassembly may be formed of extruded polystyrene foam. Each panel subassembly may include an interior layer of the thermally-insulating material. The interior layer may be formed of extruded polystyrene foam. Each panel subassembly may include connecting elements positioned in the interior layer so that they extend into the concrete portion.

The system may include at least one threaded rod secured to the foundation, and positioned in an aperture of the panel subassembly formed in a lower concrete beam thereof. The panel subassembly may be secured to the threaded rod using a fastener.

At least one floor element of the building may be secured to and at least partially supported by a selected one of the panel subassemblies. A concrete exterior layer of the selected one of the panel subassemblies may extend beyond an upper concrete beam, so that a top surface of the upper concrete beam and a top surface of the at least one column define a ledge on which the floor element may be positioned and supported thereby. At least one threaded rod may be formed in the upper concrete beam of the selected one of the panel subassemblies, and the at least one threaded rod may be positioned in an aperture of the floor element. The floor element may be secured to the threaded rod using a fastener.

A second panel subassembly may be positioned on the floor element, and may be substantially vertically aligned with a lowermost panel subassembly. The system may include at least one threaded rod formed in an upper concrete beam of the lowermost panel subassembly, and the at least one threaded rod may be positioned in an aperture of the floor element and an aperture of the second panel subassembly formed in a lower concrete beam thereof. The second panel subassembly and the floor element may be secured to the threaded rod using a fastener.

Two of the panel subassemblies may be transversely connected. A gap formed between substantially abutting edges of the two of the panel subassemblies may be filled with grout. A stop pocket formed by parallel portions and partially non-parallel portions of each of the edges may be filled with the grout. A connector may be received in at least one slot including a slot segment in each of the panel subassemblies, and may be encompassed with the grout.

According to an aspect of the present disclosure, a method of erecting a building on a foundation is provided, the method including: providing a plurality of panel subassemblies, each panel subassembly including at least one column including a thermally-insulating material, and a concrete portion at least partially attached to the at least one column; and securing at least one of the panel subassemblies to the foundation.

The method may include lowering at least one of the panel subassemblies so that a threaded rod secured to the foundation is positioned in an aperture of the at least one of the panel subassemblies formed in a lower concrete beam thereof. The method may include cutting an opening in the thermally-insulating material of the at least one of the panel subassemblies adjacent to the lower concrete beam. The method may include injecting grout to fill extra space in the aperture around the threaded rod. The method may include securing the at least one of the panel subassemblies to the threaded rod using a fastener.

The method may include filling the opening with insulation material. The method may include securing a floor element of the building to a selected one of the panel subassemblies, so that the floor element is at least partially supported thereby. The method may include filling a gap between the floor element and a concrete exterior layer of the selected one of the panel subassemblies with material. The method may include positioning a threaded rod secured to the lowermost panel subassembly in an aperture of the floor element. The method may include securing the floor element to the threaded rod using a fastener.

The method may include positioning a second panel subassembly on the floor element substantially vertically aligned with a lowermost panel subassembly, and securing the second panel subassembly and the lowermost panel subassembly together. The method may include positioning a threaded rod secured to the lowermost panel subassembly in an aperture of the floor element and an aperture of the second panel subassembly formed in a lower concrete beam thereof. The method may include cutting an opening in the thermally-insulating material of the second panel subassembly adjacent to the lower concrete beam. The method may include injecting grout to fill extra space in the apertures around the threaded rod. The method may include securing the second panel subassembly and the floor element to the threaded rod using a fastener. The method may include filling the opening with insulation material.

The method may include bracing at least one of the panel subassemblies with a temporary support element.

The method may include transversely connecting two of the panel subassemblies together. The method may include filling a gap formed between substantially abutting edges of the two of the panel subassemblies with grout. The method may include filling a stop pocket with the grout, the stop pocket formed by parallel portions and partially non-parallel portions of each of the edges. The method may include receiving a connector in at least one slot including a slot segment in each of the panel subassemblies, and encompassing the connector with the grout.

According to an aspect of the present disclosure, a panel subassembly for use in erecting a building is provided, the subassembly including: at least one column including a thermally-insulating material; and a concrete portion at least partially attached to the at least one column.

The concrete portion may include upper and lower concrete beams. The concrete portion may include at least one horizontal rebar element in the upper and lower concrete beams. An aperture may be formed in the lower concrete beam. A threaded rod may be formed in the upper concrete beam. The concrete portion may include at least one concrete column. The concrete portion may include at least one vertical rebar element in the at least one concrete column.

The concrete portion may include a concrete exterior layer. The concrete exterior layer may extend beyond the upper concrete beam, so that a top surface of the upper concrete beam and a top surface of the at least one column define a ledge. An exterior surface of the concrete exterior layer may be colored. An exterior surface of the concrete exterior layer may be impressed with a pattern.

The concrete portion may be formed in a single precast unit. The at least one column may be formed of extruded polystyrene foam. The subassembly may include an interior layer of the thermally-insulating material. The interior layer may be formed of extruded polystyrene foam. The subassembly may include connecting elements positioned in the interior layer so that they extend into the concrete portion.

The subassembly may include at least one bracket for temporarily bracing the panel subassembly, the bracket including a rebar element embedded in the concrete portion. The subassembly may include at least one bracket for temporary connection to a crane, the bracket including a threaded sleeve positioned in the concrete portion. The subassembly may include at least one window.

According to an aspect of the present disclosure, a method of constructing a panel subassembly for use in erecting a building is provided, the method including: positioning an interior layer of thermally-insulating material inside a concrete form; positioning at least one billet of the thermally-insulating material on top of the interior layer to form at least one column of the panel subassembly; and casting concrete in the concrete form on top of the interior layer and the at least one billet to form a concrete portion of the panel subassembly at least partially attached to the at least one column.

The step of casting may include forming upper and lower concrete beams of the concrete portion. The method may include positioning horizontal rebar elements in the upper and lower concrete beams. The method may include forming at least one aperture in the lower concrete beam. The method may include forming at least one threaded rod in the upper concrete beam. The step of casting may include forming at least one concrete column of the concrete portion. The method may include positioning vertical rebar elements in the at least one concrete column.

The step of casting may include forming a concrete exterior layer of the concrete portion. The method may include forming the concrete exterior layer to extend beyond the upper concrete beam, so that a top surface of the upper concrete beam and a top surface of the at least one column define a ledge. The method may include coloring an exterior surface of the concrete exterior layer. The method may include impressing a pattern on an exterior surface of the concrete exterior layer. The method may include positioning connecting elements in the interior layer so that they extend into the concrete portion.

The method may include embedding a rebar element of a bracket in the concrete portion. The method may include positioning a threaded sleeve of a bracket in the concrete portion. The step of casting may include forming at least one window.

The panel subassembly may be assembled at a location remote from the site where the building is erected.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Figure 1A:
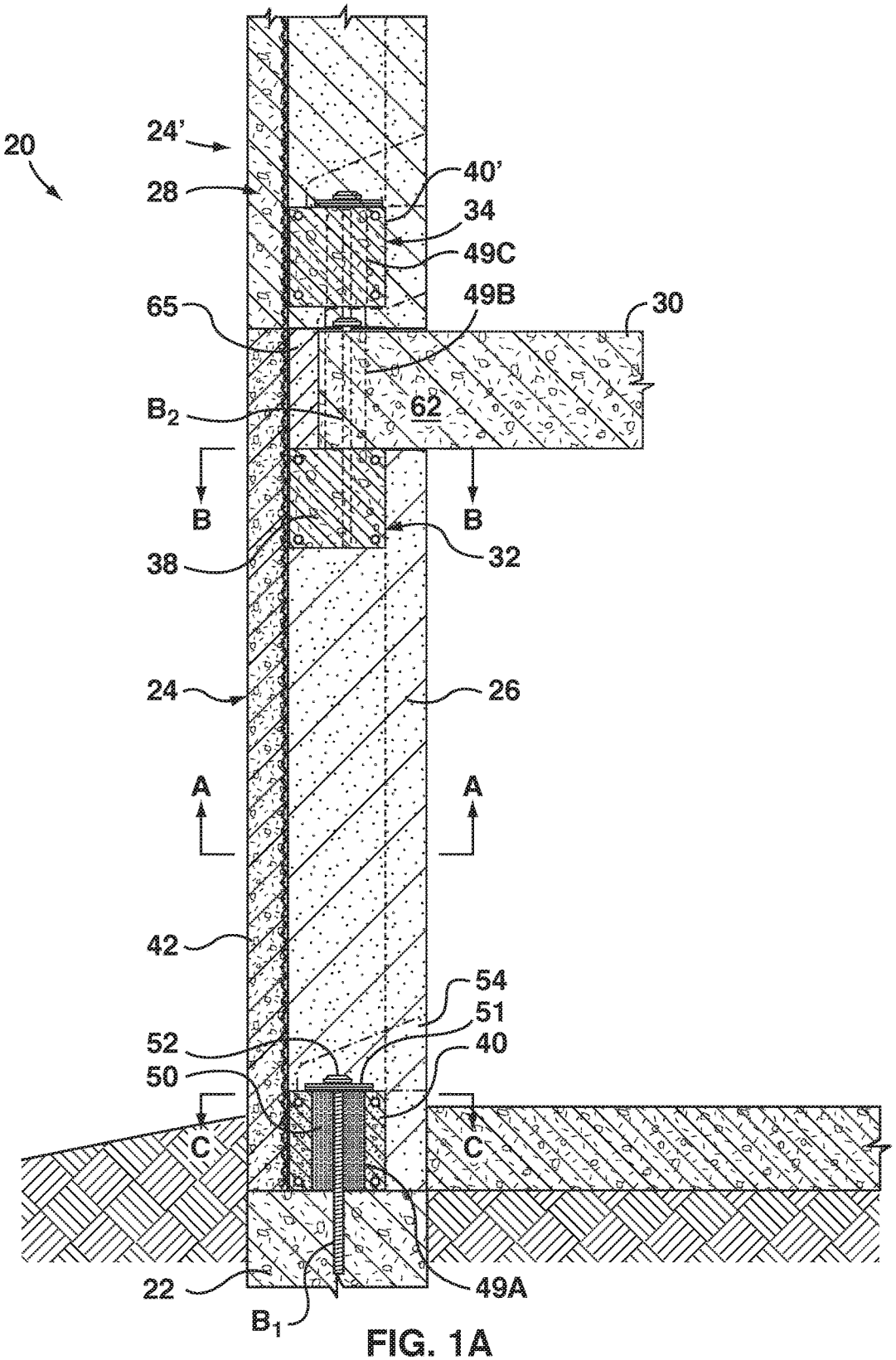
FIG. 1A is a cross-section of a portion of a building system including an exterior panel subassembly secured to a foundation and a floor element.

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

In the attached drawings, like reference numerals designate corresponding elements throughout.

Figure 3:
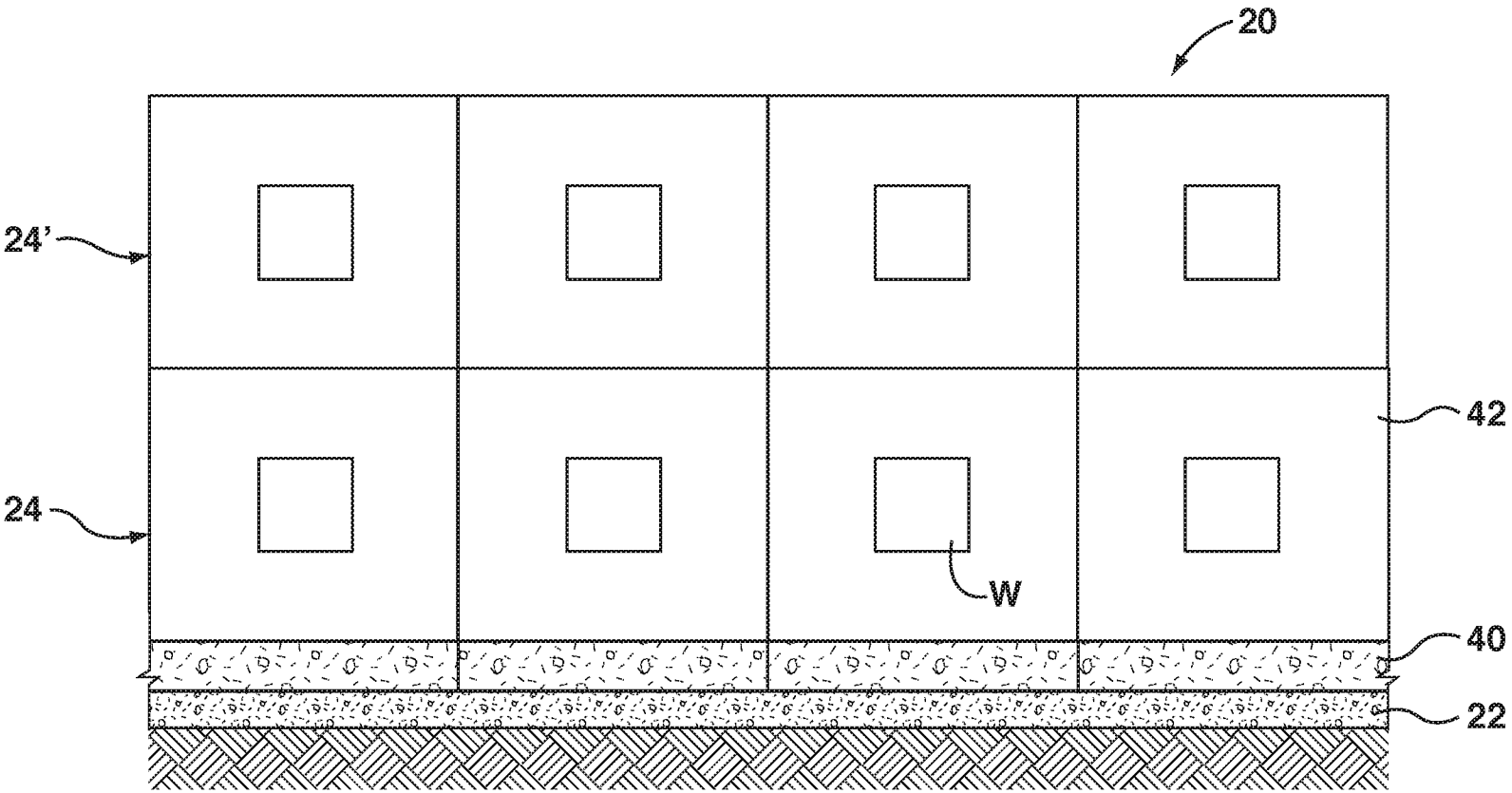
FIG. 3 is an elevation view of a front side of a building system, drawn at a smaller scale.
Figure 4A:
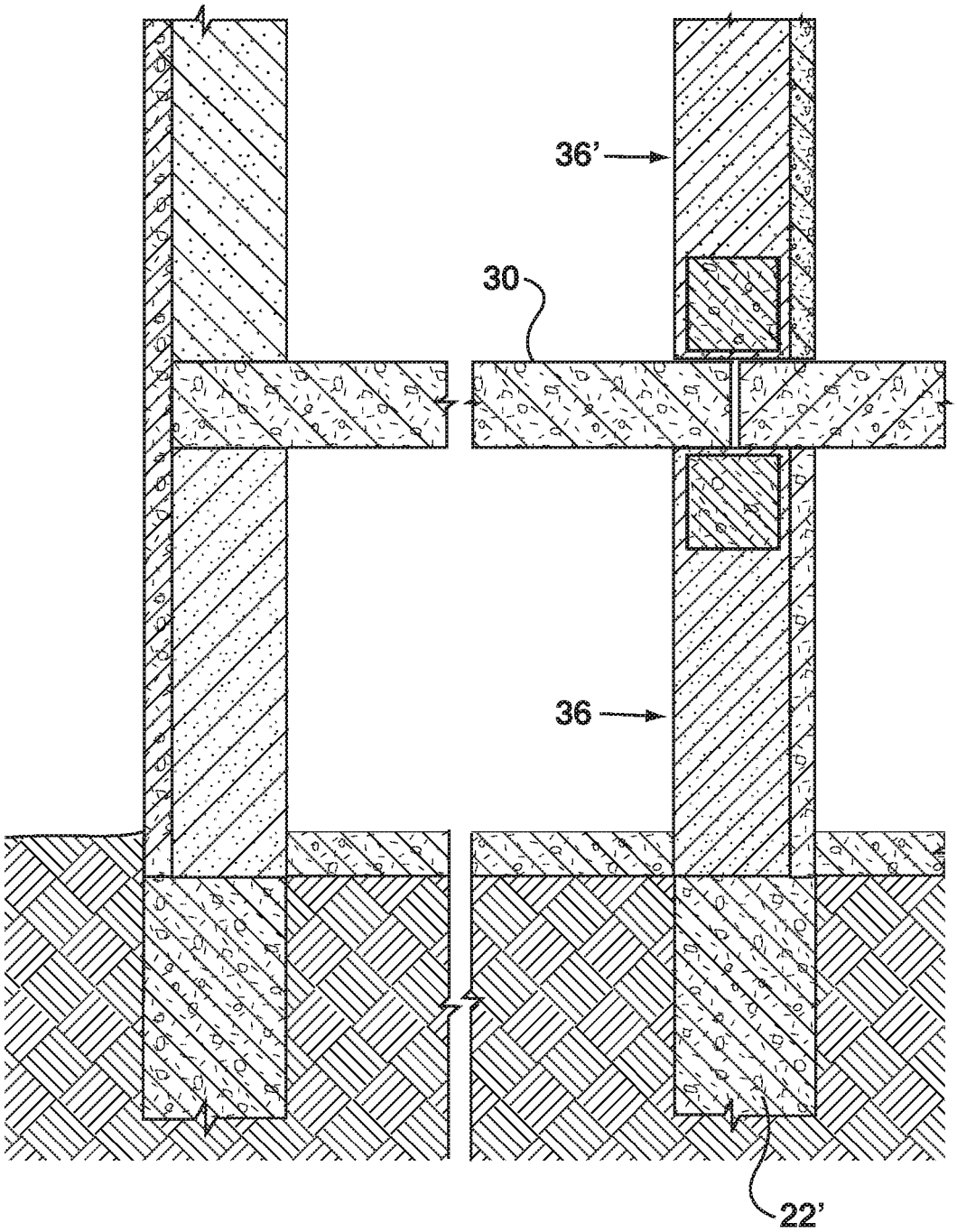
FIG. 4A is a cross-section of a portion of a building system including panel subassemblies and floor elements.

Referring to FIGS. 1A and 3, an example of a building system is indicated generally by the reference numeral 20. The system 20 is for erecting a building on a footing or foundation 22, and includes a number of exterior panel subassemblies 24. In some examples, each panel subassembly 24 includes one or more columns 26 having a thermally-insulating material, and a concrete portion 28 at least partially attached to the columns 26. Each exterior panel subassembly 24 may be secured to the foundation 22, as will be described. The building system 20 includes one or more floor slabs or elements 30 at least partially supported by selected ones of the exterior panel subassemblies 24, and a first mechanism 32 for securing the floor element 30 to the selected ones of the exterior panel subassemblies 24. The system 20 also includes a second mechanism 34 for securing the exterior panel subassemblies 24 together, as will also be described. In some examples, the building system 20 may also include one or more interior panel subassemblies 36 for at least partially supporting the floor element 30 (FIG. 4A). The interior panel subassembly 36 may also be secured to the foundation 22.

Figure 2A:
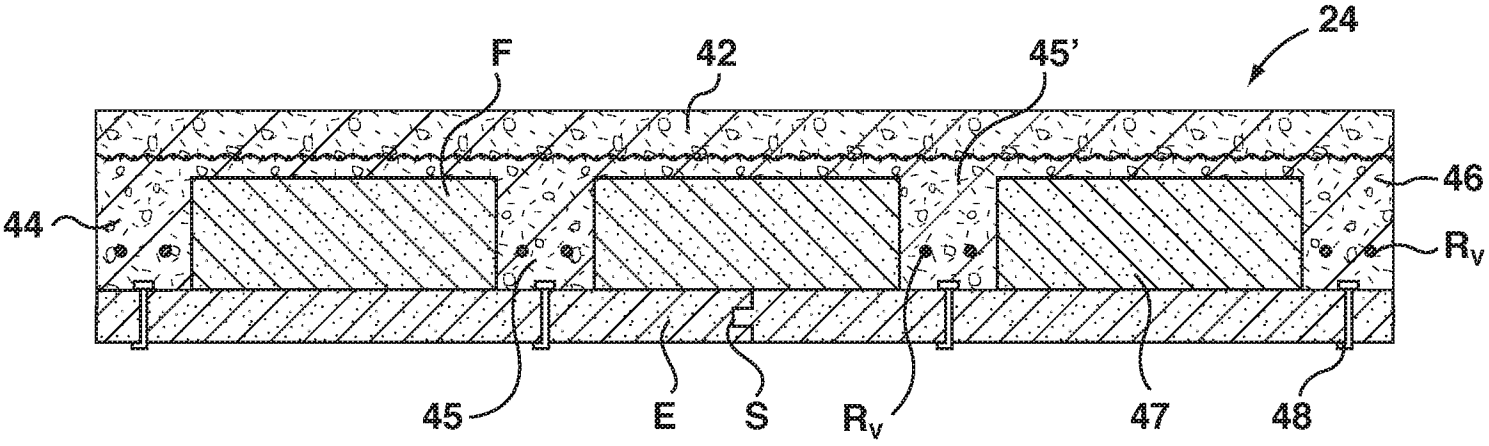
FIG. 2A is a cross-section of the panel subassembly of FIG. 1A taken along line A-A in FIG. 1A.
Figure 2B:
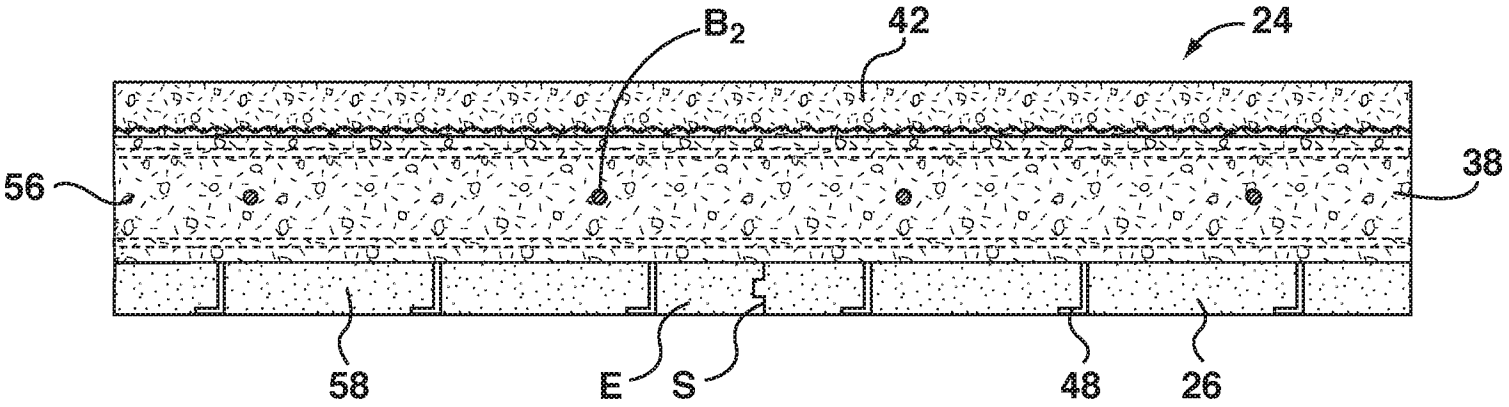
FIG. 2B is a cross-section of the panel subassembly of FIG. 1A taken along line B-B in FIG. 1A.

The exterior panel subassembly 24 may include a number of concrete elements, which may be formed in a single precast unit as the concrete portion 28. Such interconnected concrete elements are as follows. Referring to FIGS. 1A and 2D, in some examples, the exterior panel subassembly 24 includes upper and lower concrete beams 38, 40. The exterior panel subassembly 24 may also include a concrete exterior layer 42 (FIG. 1A). In addition, referring to FIG. 2A, the exterior panel subassembly 24 may include concrete columns 44, 45, 45' and 46. Interior columns 47 of thermally-insulating material are positioned between the concrete columns 44, 45, 45' and 46.

The exterior panel subassembly 24 is relatively strong, and this is partly because the concrete elements are included in a single, integrally-formed, precast unit, as noted above. The exterior panel subassembly 24 may be assembled at a factory, i.e. rather than at the site where the system 20 is erected. (Other panel subassemblies, described below, are generally similar to the exterior panel subassembly, and it therefore will be understood that the other panel subassemblies may also be formed at the factory.) Because ambient conditions are more easily controlled in the factory, forming the exterior panel subassembly 24 may be more efficient and more likely to result in products with consistent quality.

The columns 26 may be formed of any suitable material. In some examples, the columns are formed of extruded polystyrene (EPS) foam. This material may be suitable because it is relatively strong and a good thermal insulator and vapor barrier, and also because it has a relatively low density, e.g., approximately 28-45 kg/m$^3$ (approximately 1.7-2.8 lbs./cu.ft.). Referring to FIGS. 2A and 2D, the exterior panel subassembly 24 may also include plastic or steel connecting elements 48. As will be described, due to the insulative qualities of EPS foam, the system 20 generally does not require additional insulation to be positioned inside the system, once assembled. This is because, as noted above, the panel subassemblies may include EPS foam therein, to provide thermal insulation.

Figure 9A:
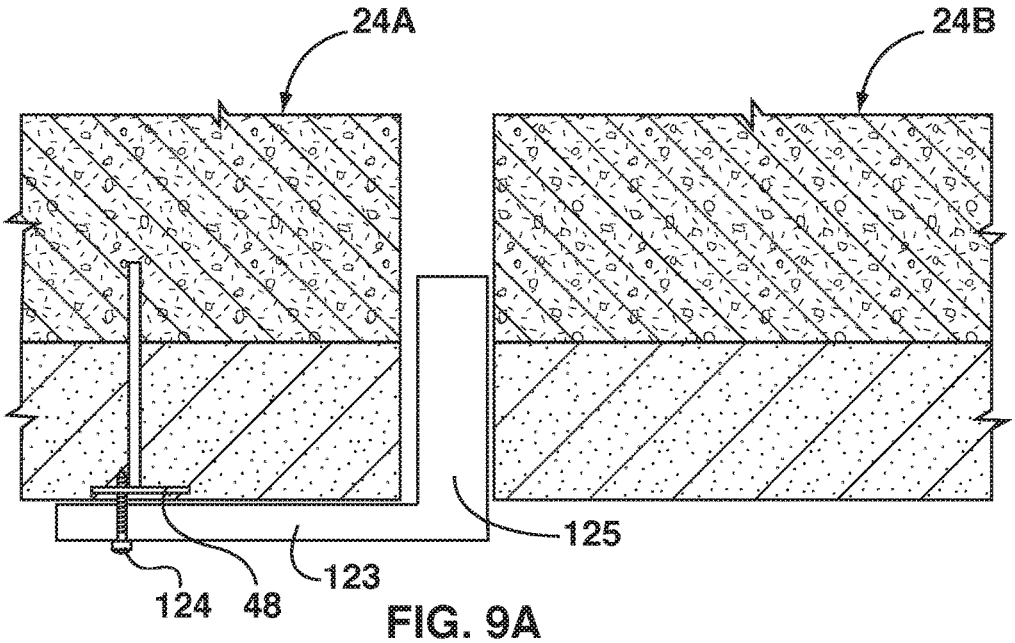
FIG. 9A is a cross-section of a portion of a building system including two exterior panel subassemblies and a shim element.
Figure 9B:
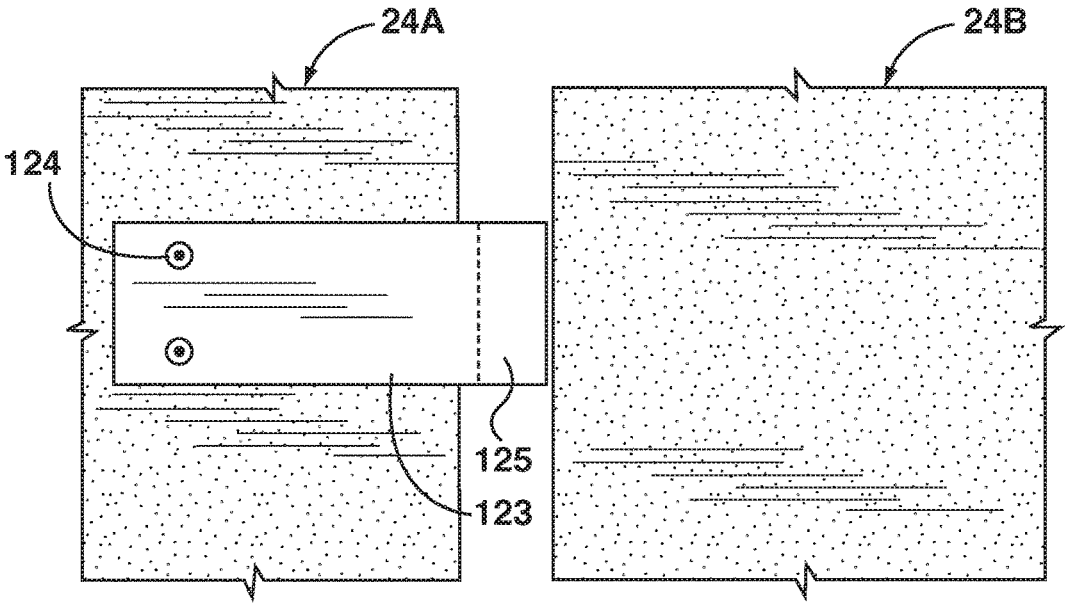
FIG. 9B is a front view of the panel subassemblies and the shim element of FIG. 9A.

In some examples, the construction of the panel subassembly begins with positioning an interior layer E of EPS foam inside a concrete form (not shown). Referring to FIG. 2A, the EPS foam interior layer may be made of two or more pieces that fit together to define a seam S therebetween. The seam S may define at least one right angle, so that the EPS foam functions as a vapor barrier. Connecting elements 48 may be positioned in the layer E so that they extend into the concrete, for secure connection of the concrete portion 28 to the layer E. The connecting elements 48 may be continuous or non-continuous, and they also may be of any suitable material, e.g., they may be made of steel or plastic. Referring to FIGS. 9A and 9B, the connecting elements 48 may be used to secure a shim element 123 to a panel subassembly 24A by a fastener 124. The shim element 123 includes an orthogonal spacer portion 125 that is used to space apart the panel subassemblies 24A, 24B a transverse dimension, when the panel subassemblies 24A, 24B are positioned adjacent to one another, and prior to transverse connection. Different shim elements may be used to set the transverse dimension as desired.

Next, billets F made of EPS foam may be positioned on the layer E. In addition, vertical rebar elements $R_V$ may be positioned in gaps between the billets F. Also, in the example illustrated, horizontal rebar elements $R_H$ are positioned above and below the billets, as shown in FIG. 2D. It will be understood that, to form the panel subassembly, the layer E is positioned substantially horizontally, inside a concrete form, and the billets F are positioned on top of the layer E. (It will also be understood that, in this paragraph, "horizontally" and "vertically" refer generally to the positioning of the rebar elements once the panel subassembly are installed, and positioned substantially vertically.)

The panel subassembly may be constructed so that it meets thermal R value, vapor barrier, and rain guide requirements of applicable regulations and building codes, e.g., state, provincial, and federal building codes, and architectural associations. In addition, the panel subassembly may be formed to meet applicable structural requirements, and also applicable fire code requirements (e.g., providing necessary fire separation values). The net result may be a relatively lightweight but relatively strong exterior panel subassembly 24 that may be positioned as required at the site and, once secured in place, serves its purpose with minimal additional work required, as will also be described. As a result, the system may be assembled in a relatively short time period, and significant costs saving are consequently achievable.

Referring to FIG. 1A, a lowermost one of the exterior panel subassemblies 24 may be secured to the foundation 22 by one or more threaded rods $B_1$ (i.e. conventionally secured in the foundation 22) which, when the exterior panel subassembly is positioned thereon, extend through the lower concrete beam 40. The exterior panel subassembly 24 may be lowered into place by a crane (not shown), so that the rods $B_1$ are properly positioned in apertures 49A.

In some examples, the apertures 49A are formed in the lower concrete beam 40 when the lower concrete beam 40 is made. The apertures 49A may be substantially larger in diameter than the rods $B_1$ to be positioned therein. As will be described, once the exterior panel subassembly 24 is positioned on the rods $B_1$, the extra space around the rods B may be filled with non-shrink grout 50.

Figure 2C:
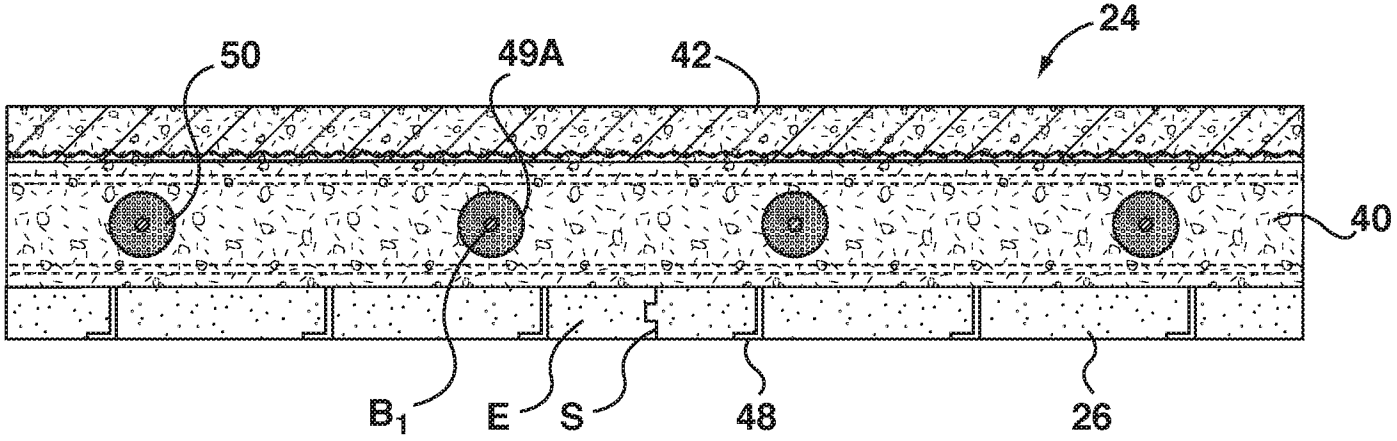
FIG. 2C is a cross-section of the panel subassembly of FIG. 1A taken along line C-C in FIG. 1A.
Figure 2D:
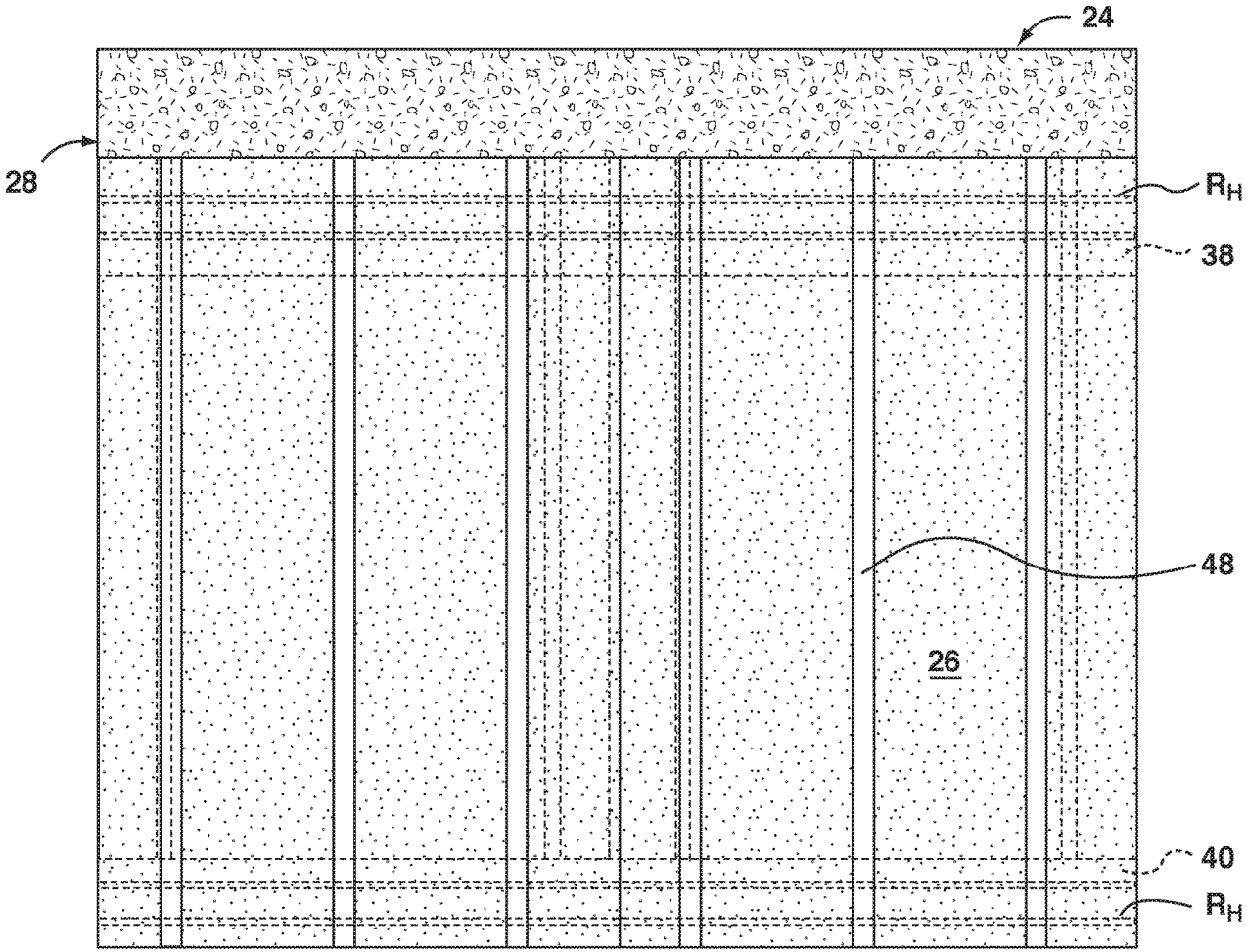
FIG. 2D is an elevation view of an interior side of the panel subassembly of FIG. 1A.

Referring to FIG. 2C, in the example illustrated, a number of the apertures 49A are formed in the lower concrete beam 40, and the bolts $B_1$ are receivable therein.

Once the exterior panel subassembly 24 is in position on the rods $B_1$, the subassembly 24 may be secured to the rods $B_1$ using plates 51 and suitable nuts 52 (FIG. 1A), or other suitable fasteners. In order to enable the injection of the non-shrink grout and the securing of the nut 52 on the rod $B_1$, an opening may be made, by manually cutting the EPS adjacent to the lower concrete beam 40. In some examples, the opening is filled with a suitable insulation material after the non-shrink grout is injected and the exterior panel subassembly 24 is secured to the rods $B_1$. For instance, an expanding polyurethane (i.e. provided in sprayable form) may be a suitable insulation material. It will be understood that the exterior panel subassembly 24 as illustrated in FIG. 1A shows expanding polyurethane 54 that has been sprayed in the opening to fill it after the opening is no longer needed.

In the example illustrated, the concrete exterior layer 42 extends beyond the upper concrete beam 38, so that a top surface 56 of the upper concrete beam 38 and top surfaces 58 of the columns 26 of EPS (FIG. 2B) define a ledge on which the floor element 30 is positioned and supported thereby.

Figure 1B:
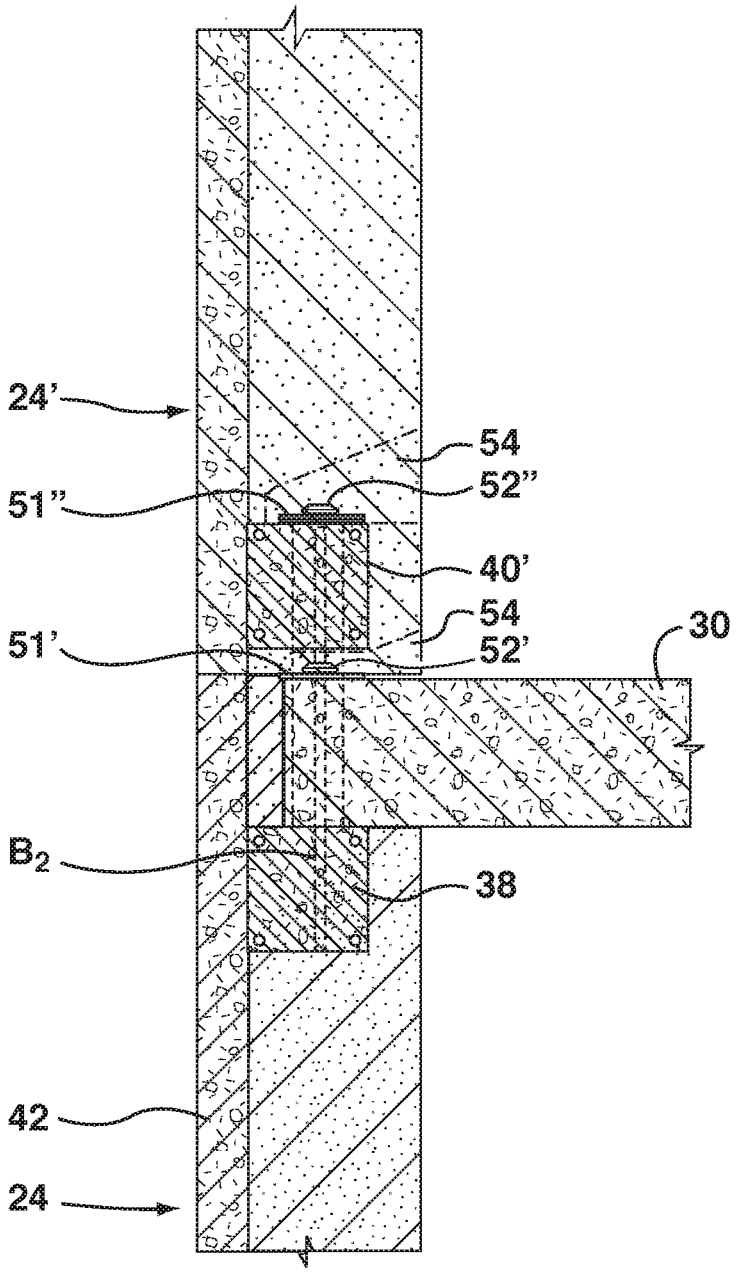
FIG. 1B is a part of the system of FIG. 1A.

Referring to FIGS. 1A and 1B, a second exterior panel subassembly (designated 24' for convenience) may be positioned on the floor element 30, and substantially vertically aligned with the lowermost exterior panel subassembly 24. In some examples, the upper concrete beam 38 includes a threaded rod $B_2$, the floor element 30 includes an aperture 49B, and the exterior panel subassembly 24' may include a lower concrete beam 40' with an aperture 49C. In some examples, as illustrated, the mechanism 32 may include the threaded rod $B_2$. The threaded rod $B_2$ may be cast in place, i.e. it is positioned in the upper concrete beam 38 when the upper concrete beam 38 is formed.

In order to secure the floor element 30 between the panel subassemblies 24, 24', a part 62 of the floor element 30 is positioned on the top surfaces 56, 58 so that the threaded rod $B_2$ extends through the aperture 49B. In the example illustrated, a plate 51' and a nut 52' are positioned on the threaded rod $B_2$ to secure the floor element 30 to the upper concrete beam 38 (FIG. 1B). Also, the balance of the aperture 49C may be substantially filled with non-shrink grout 50.

The second exterior panel subassembly 24' is positioned so that a top end of the threaded rod $B_2$ is received in the aperture 49C. The aperture 49C extends through the lower concrete beam 40'. An opening may be manually cut in the EPS foam to enable a plate 51" and a nut 52" to be positioned on the top end of the threaded rod $B_2$. In this way, the second exterior panel subassembly 24' may be secured to the lower exterior panel subassembly 24, and to the floor element 30 positioned therebetween. As described above, once the fastener has been secured, the opening may be filled with expanding polyurethane 54.

In the example illustrated, when the floor element 30 is positioned on the surfaces and the apertures are substantially vertically aligned, a gap 65 may be formed between the floor element 30 and the concrete exterior layer 42 (FIG. 1A). As shown, the gap 65 may be filled with a material that provides thermal insulation and a vapor barrier at the end of the floor element 30, e.g., EPS foam or spray foam.

Referring to FIG. 3, in the example illustrated, the exterior panel subassembly 24 includes one or more windows W therein. The windows W may be built into the exterior panel subassembly 24 when it is formed (as required), thereby saving a significant amount of time in erecting the building. (It will be understood that the windows W are omitted from all views except FIG. 3, for clarity of illustration.) The exterior panel subassembly 24 may also include one or more doors therein (not shown).

The concrete exterior layer 42 may have such exterior surface finish as is desired. In some examples, the concrete exterior layer 42 has a patterned concrete finish, in which the concrete exterior layer 42 is colored and has a pattern impressed thereon as desired. The advantage of this is that the exterior finish of the exterior panel subassembly 24 is provided before installation, excluding only minor finish items that may be needed. This is advantageous because it results in faster completion of the construction of the building.

Figure 4B:
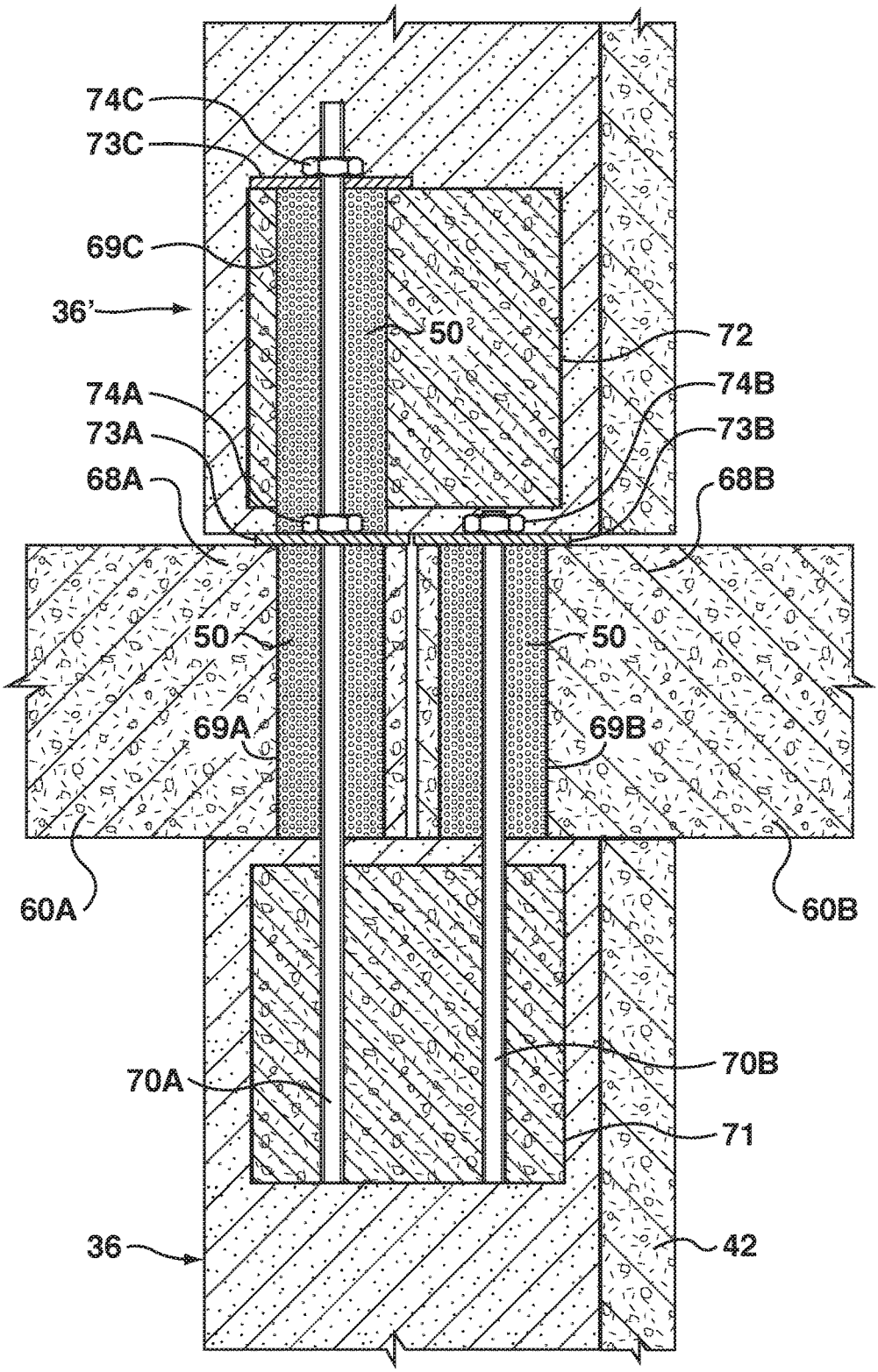
FIG. 4B is a part of the system of FIG. 4A, drawn at a larger scale.

The lowermost interior panel subassembly 36 is illustrated in FIGS. 4A and 4B, positioned on a foundation 22'. It will be understood that the interior panel subassembly 36 includes a lower beam (not shown in FIG. 4B) like that in the exterior panel subassembly 24, and the interior panel subassembly 36 is secured to the foundation and threaded rods therein in the same manner as the exterior panel subassembly 24 is secured to the foundation 22, as described above. It will also be understood that a number of elements are omitted from FIG. 4A for clarity of illustration.

Referring to FIG. 4B, respective ends 68A, 68B of two floor slabs 60A, 60B are positioned on the lowermost interior panel subassembly 36. Another interior panel subassembly 36' is positioned on top of the respective ends 68A, 68B of the floor slabs 60A, 60B. The ends 68A, 68B have respective apertures 69A, 69B therein. In the example illustrated, a threaded rod 70A is in situ, being cast in an upper beam 71 of the lower interior panel subassembly 36. In general, the interior panel subassemblies 36 may be formed in the same way as the exterior panel assemblies.

In the example illustrated, the ends 68A, 68B are positioned on the interior panel subassembly 36 so that the threaded rods 70A, 70B are received in the apertures 69A, 69B, respectively. The plates 73A, 73B and the nuts 74A, 74B are positioned on the threaded rods 70A, 70B, and the nuts are tightened, to secure the floor slabs 60A, 60B to the interior panel subassembly 36. The apertures 69A, 69B may also filled with non-shrink grout 50.

As shown in FIG. 4B, an upper end of the threaded rod 70B is positioned in an aperture 69C in a lower beam 72 of the upper interior panel subassembly 36'. A plate 73C and a nut 74C are positioned on the upper end of the threaded rod 70A. The nut 74C is tightened, to secure the lower beam 72 and the upper beam 71 and the ends 68A, 68B therebetween together. The aperture 69C may also be filled with non-shrink grout 50.

It will be understood that, in order to secure the interior panel subassemblies 36 and 36' and the floor slabs 60A, 60B together, openings are cut in the EPS columns of the interior panel subassemblies 36, 36', and such openings are subsequently filled with suitable insulation material, in the same manner as described above in connection with the exterior panel subassemblies. For instance, in some examples, spray foam (e.g., expanding polyurethane foam) is sprayed into the openings to fill them. For clarity of illustration, the refilled openings are not outlined in FIG. 4B. Also, it will be understood that relatively large apertures are provided in the concrete elements described above, to enable the bolts to be positioned and the nuts to be tightened, as described above. The excess portions of such apertures (i.e. the portions of the apertures not occupied by the threaded rods 70A, 70B) may be filled with non-shrink grout 50, as shown in FIG. 4B.

Figure 4D:
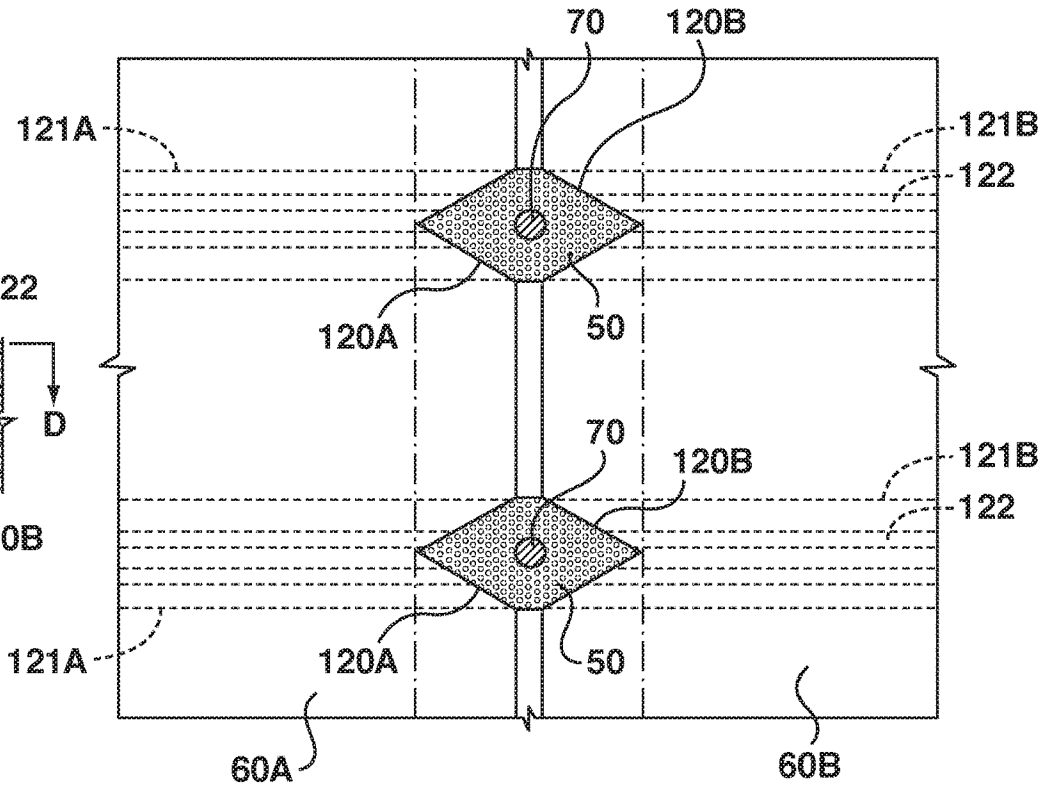
FIG. 4D is a cross-section of two abutting floor elements taken along line D-D in FIG. 1A.
Figure 4C:
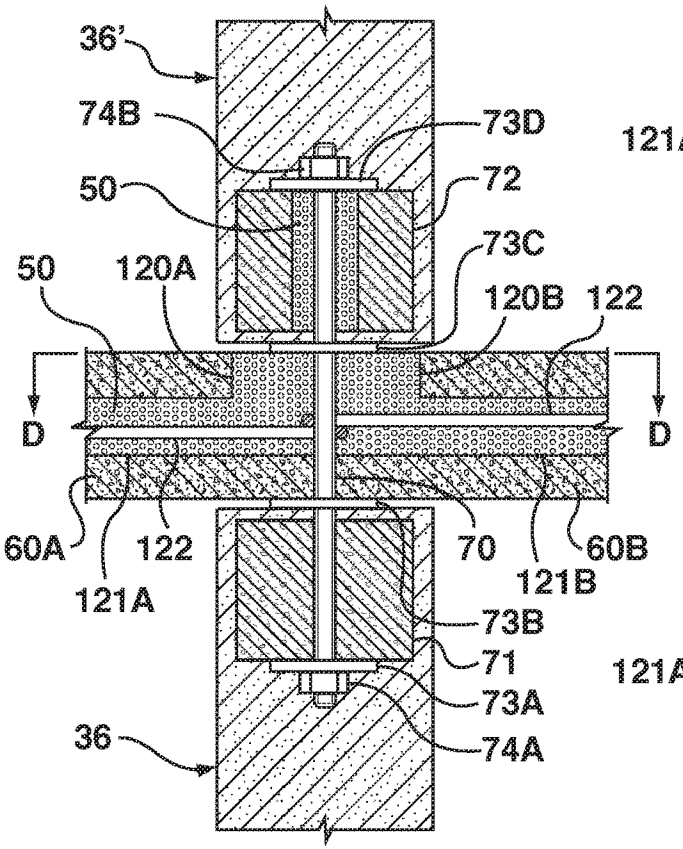
FIG. 4C is a cross-section of a portion of a building system including panel subassemblies and floor elements.

Referring to FIGS. 4C and 4D, a centerwall connection is shown formed between panel subassemblies 36, 36' and floor elements 60A, 60B. In the example illustrated, V-shaped notches 120A, 120B are cut in the floor elements 60A, 60B to expose the central channels 121A, 121B of each. Generally U-shaped rebar elements 122 are positioned in the channels 121A, 121B, on either side of the threaded rod 70, and the channels 121A, 121B may be filled with non-shrink grout 50.

Figure 7A:
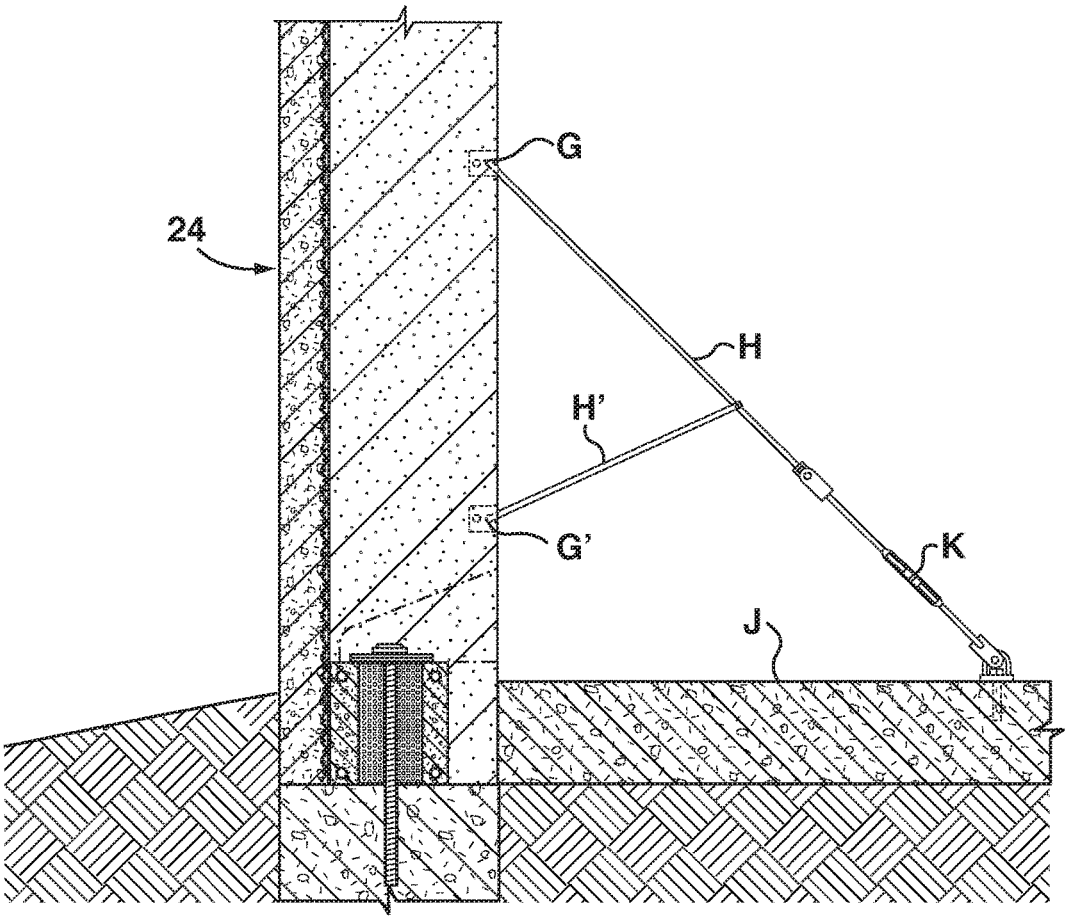
FIG. 7A is a cross-section of a portion of a building system showing a temporary support element engaged with a panel subassembly.

In some examples, the exterior panel subassemblies and the interior panel subassemblies are transversely connected to each other, as will be described. Such transverse connections may be made between laterally adjacent panel subassemblies, after such panel subassemblies have been secured vertically. After each panel subassembly has been secured vertically, but before it is secured laterally, the panel subassembly may be temporarily braced or stabilized until the panel assembly is secured laterally. In some examples, this is done using brackets G and G' (FIGS. 7A, 7B) that is provided for the purpose. (It will be understood that the brackets G and G' are omitted from the other drawings herein for clarity of illustration.) Shortly after the panel subassembly is vertically secured to the foundation, and before the crane is disconnected therefrom, a temporary support element H may be secured at its respective ends to the upper bracket G and the floor J, respectively. Support element H' may be secured at its respective ends to the lower bracket G' and midway of the support element H, respectively. The upper end of the support element H' may be pivotably attached to the support element H.

In some examples, to stabilize a single panel subassembly, a suitable number of temporary support elements are connected to respective brackets spaced apart from each other along an inner side of the panel subassembly. It will also be understood that the end of the temporary support element located at the floor is pivotably connected with the floor via a suitable bracket. The temporary support element H may include a turnbuckle device K, to facilitate minor adjustments in the position of the panel subassembly. Once a sufficient number of the panel subassemblies has been laterally connected together, the temporary support elements that have been used with them are removed, for use with other newly-installed panel subassemblies.

Figure 7B:
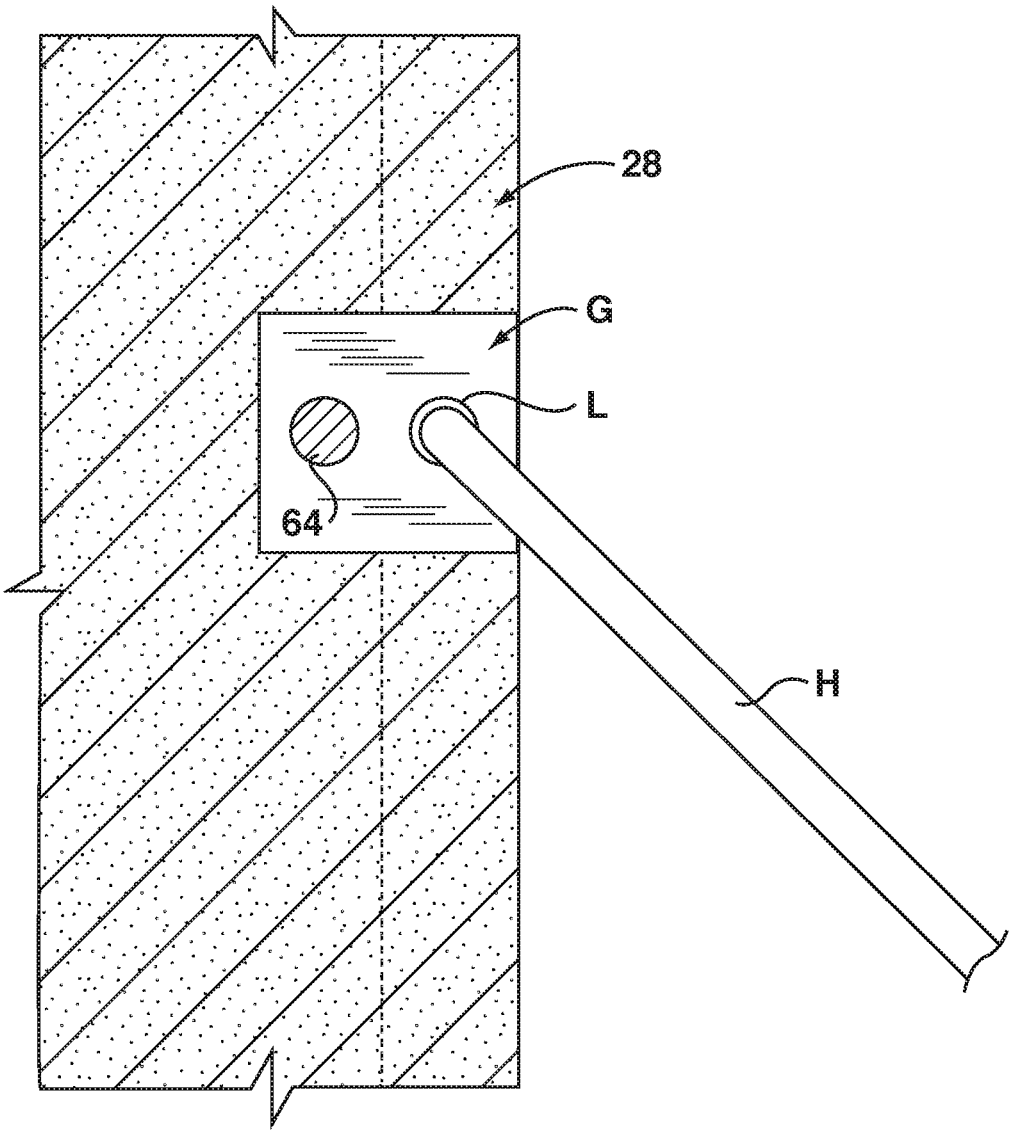
FIG. 7B is a view of a portion of the temporary support element of FIG. 7A, drawn at a larger scale.
Figure 7C:
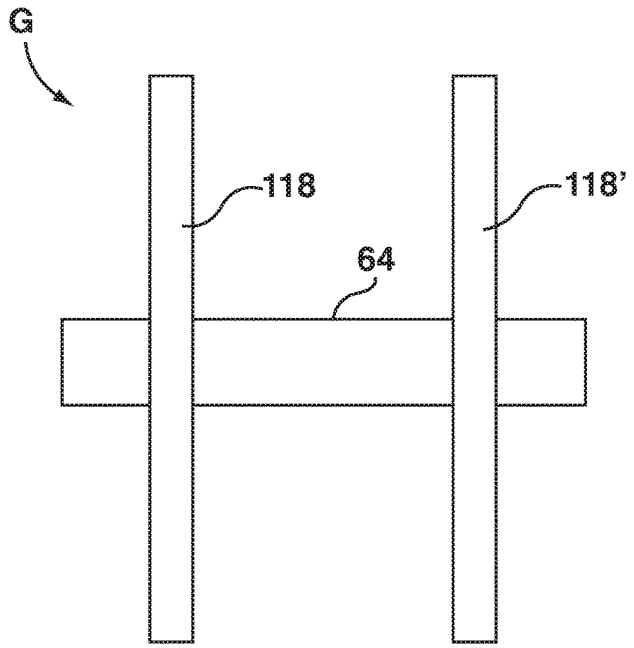
FIG. 7C is a front view of a bracket of the temporary support element of FIG. 7A.
Figure 8B:
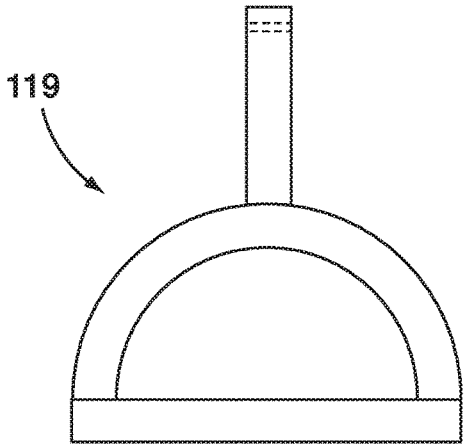
FIG. 8B is front view of the handle of FIG. 8A.
Figure 8A:
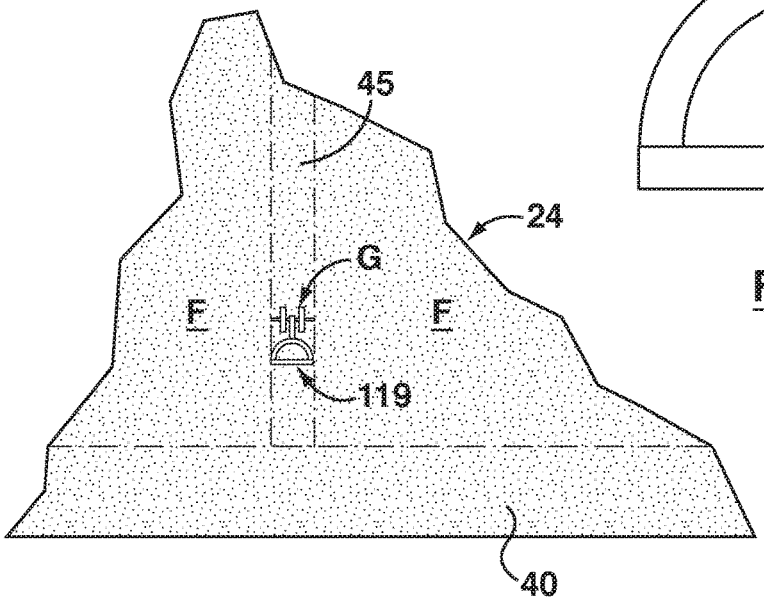
FIG. 8A is a view of a portion of an interior side of a panel subassembly with a handle.

Referring to FIGS. 7B and 7C, in the example illustrated, the bracket G is held in position by rebar element 64, embedded in the concrete portion 28 when the panel subassembly is formed. The bracket G also includes side plates 118, 118', and a hole L to which the upper end of the temporary support element H is pivotably attached. Referring to FIGS. 8A and 8B, a handle 119 may be used with the bracket G, instead of the support element H, to assist with manually moving the panel subassemblies.

Figure 5A:
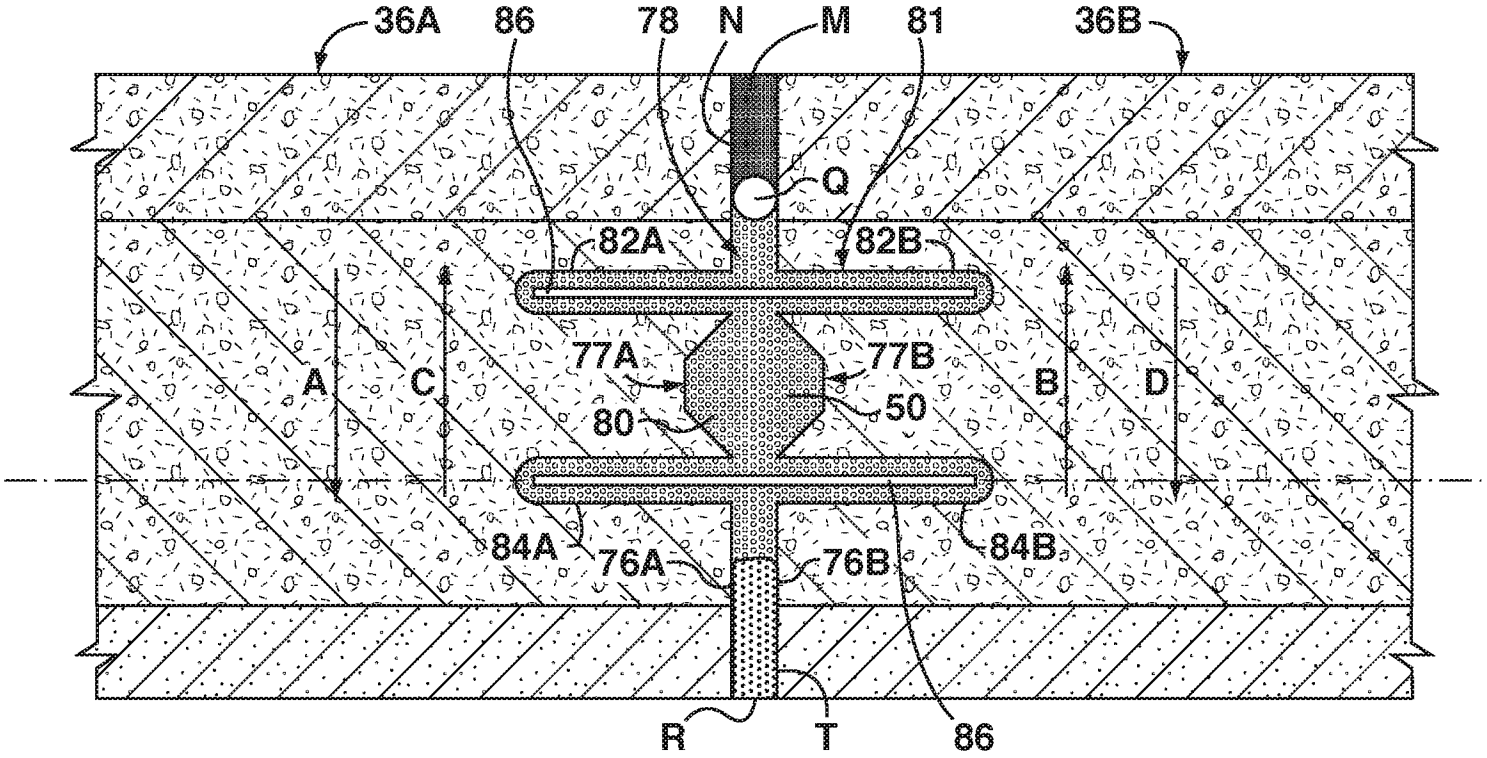
FIG. 5A is a top view of two abutting panel subassemblies connected by a connector, drawn at a larger scale.
Figure 5B:
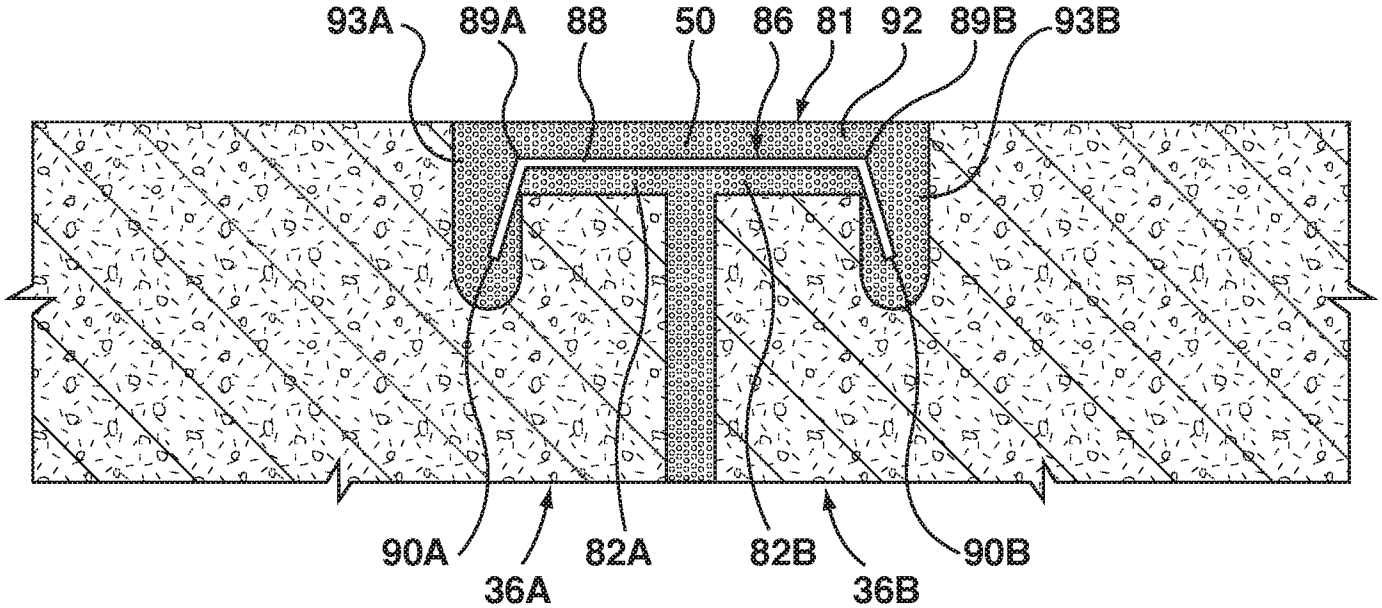
FIG. 5B is a cross-section of the connector of FIG. 5A.

Referring to FIGS. 5A and 5B, two interior panel subassemblies (identified for convenience as 36A and 36B, respectively) are shown positioned beside each other when they are secured to the foundation. The interior panel subassemblies 36A, 36B are positioned so that respective edges 76A, 76B thereof are substantially abutting. Referring to FIG. 5A, the edges 76A, 76B are, in general, substantially parallel to each other. When the interior panel subassemblies 36A, 36B are in position and secured to the foundation, the edges 76A, 76B may include partially non-parallel portions 77A, 77B. The parallel portions of the edges 76A, 76B substantially include one or more pockets or gaps 78 therebetween. It will be understood that the gap 78 as illustrated in FIGS. 5A and 5B has a width that is exaggerated, for clarity of illustration.

In the example illustrated, the portions 77A, 77B are formed to define a relatively large stop pocket, shown in FIG. 5A as being filled with non-shrink grout 50, and identified in FIG. 5A by reference numeral 80. The pocket 80 is a cavity to be filled with non-shrink grout 50 that, once so filled, the non-shrink grout 50 extends laterally away from the edges to at least partially obstruct relative movement of the subassemblies 36A, 36B in the substantially opposite directions indicated respectively by arrows A and B, or by arrows C and D, as the case may be.

The subassemblies 36A, 36B may include slots 81 (including slot segments 82A, 82B) and 83 (including slot segments 84A, 84B). The slot segments 82A, 84A are formed in the panel subassembly 36A, and the slot segments 82B, 84B are formed in the panel subassembly 36B. Referring to FIG. 5A, in the example illustrated, the slot segments 82A, 82B are formed substantially orthogonal relative to the substantially parallel portions P of the edges 76A, 76B. The slots 81, 83 are formed in the top surfaces 56 of the upper concrete beams of the subassemblies 36A, 36B. The respective pairs of slot segments 82A, 82B and 84A, 84B are formed so that the slot segments in each of the respective pairs are substantially aligned with each other, once the panel subassemblies are positioned on and secured to the foundation. In addition, each of the slots 81, 83 may have a particular configuration in which a connector 86 is receivable, to span the gap 78 and thereby connect the subassemblies 36A, 36B to each other.

For convenience, only one of the slots 81, 83 is described and is illustrated in FIG. 5B, but the two slots 81, 83 may be identical in all relevant respects. In the example illustrated, each of the connectors 86 includes an elongate central part 88 extending between first and second ends 89A, 89B thereof (FIG. 5B). In some examples, the connector 86 also includes second parts 90A, 90B at each end of the central part 88, and positioned at least partially transverse relative to the central part 88. In order to receive the connector 86 therein and the non-shrink grout 50 encompassing each connector 86, the slot segments 82A, 82B of the slot 81 may each include a main portion 92 and two end portions 93A, 93B. Referring to FIG. 5B, the central part 88 of the connector 86 is receivable in the main portion 92 of each of the slot segments 82A, 82B, and the second parts 90A, 90B are respectively receivable in the end portions 93A, 93B.

In some examples, non-shrink grout 50 is positioned in the slot, and then the connector 86 is positioned in the slots 81, 83, i.e. in the non-shrink grout 50. The transverse connection provided by the connector 86 embedded in the non-shrink grout 50 secures adjacent panel subassemblies to each other laterally, and prevents transverse movement of the adjacent panel subassemblies. After the non-shrink grout 50 has hardened, construction of the system may continue.

Referring to FIG. 5A, in the example illustrated, caulking M is positioned in an exterior portion N of the gap 78. In some examples, at least one caulking backer rod Q is positioned in the gap 78 to back the caulking M. The caulking M forms a rain barrier. Those skilled in the art would also be aware of suitable caulking materials. In some examples, the color of the caulking M is selected based on the exterior finish of the panel subassemblies.

An insulation barrier R may be positioned in an interior portion T of the gap 78 (FIG. 5A). Due to the caulking M, the non-shrink grout 50, and the insulation barrier R, the joint as illustrated in FIG. 5A may satisfy regulatory (i.e. applicable building code) requirements. Any suitable material may be the insulation material forming the insulation barrier. For example, the expanding polyurethane spray foam referred to above may be a suitable insulation material forming the insulation barrier R.

For convenience, only the transverse connections between the interior panel subassemblies 36A and 36B are shown in FIGS. 5A, 5B and described. It will be understood that the transverse connections between the exterior panel subassemblies may be generally the same as the transverse connections of the interior panel subassemblies.

Figure 5C:
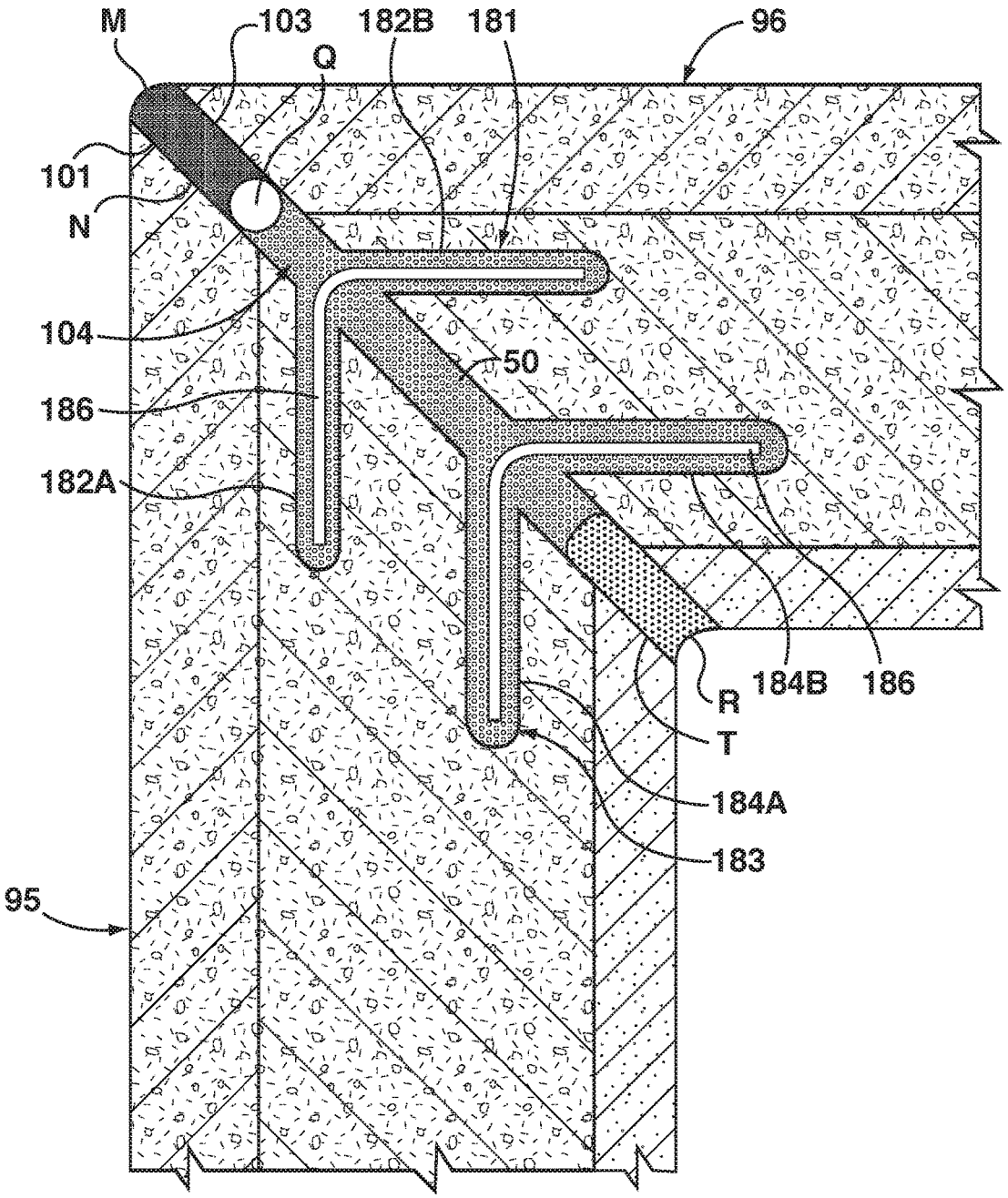
FIG. 5C is a top view of two abutting corner panel subassemblies positioned to form a corner.

Referring to FIG. 5C, where panel subassemblies 95, 96 are formed to define a corner, the panel subassemblies may include edges 101, 103 formed to cooperate. The edges 101, 103 define one or more gaps 104 therebetween. (It will be understood that the gap 104 is exaggerated in FIG. 5C for clarity of illustration.) The panel subassemblies 95, 96 may include slots 181, 183, and the slots 181, 183 may include slot segments 182A and 182B and 184A and 184B, respectively. A connector 186 is receivable in each slot 181, 183. It will be understood that the connector 186 may be substantially the same as the connector 86, except that the connector 186 in plan view substantially defines a right angle, as shown. The slots 181, 183 and the middle portions of the gaps 104 between the edges 101, 103 may be substantially filled with non-shrink grout 50 before the connectors are positioned in the slots 181, 183. In the example illustrated, the exterior portion N of the gap 104 is filled with caulking M, backed by the caulking backer rod Q, and an insulation barrier R is positioned in the interior portion T of the gap 104.

Referring to FIGS. 6A, 6B, 6C and 6D, a mechanism 105 may be included for locating the panel subassemblies 24, 36, 95, 96 at the construction site. In the example illustrated, the mechanism 105 includes one or more brackets 107 for temporary connection to a crane (not shown), and one or more fasteners 109 for connecting the panel subassembly to the brackets 107. For the purposes of illustration, the following discussion is limited to the exterior panel subassembly 24, but the mechanism 105 may be used with the exterior and the interior panel subassemblies. In some examples, the bracket 107 is formed to be secured to the top surface 56 of the upper concrete beam 38.

Figure 6A:
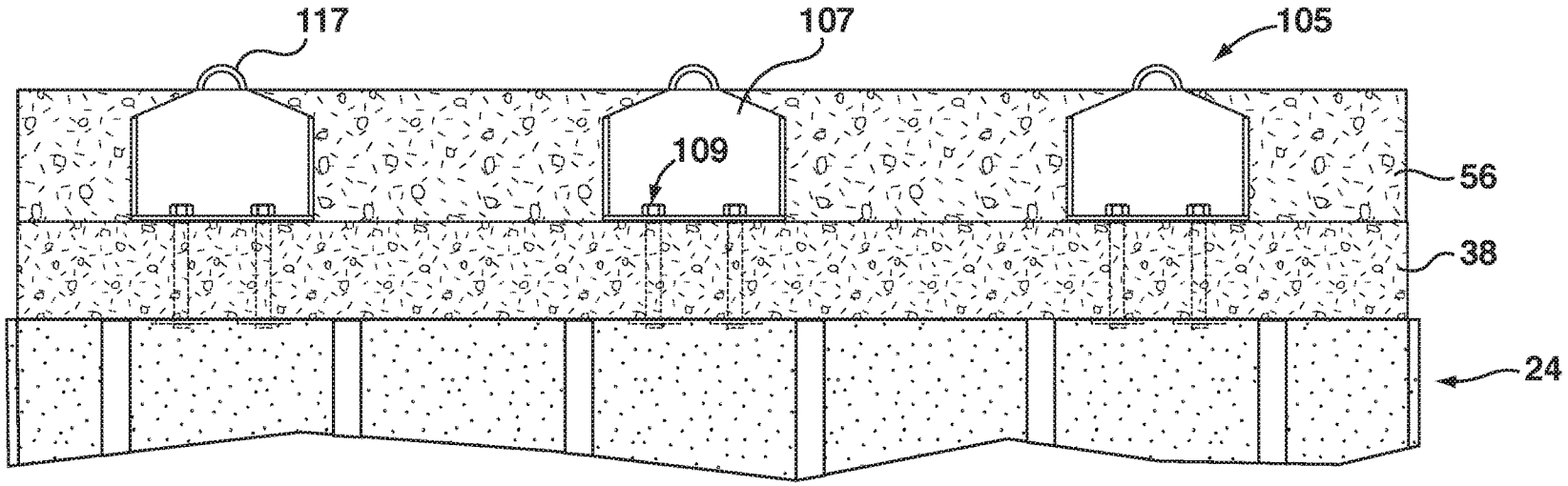
FIG. 6A is a front view of a mechanism for locating the panel subassemblies at the construction site.
Figure 6B:
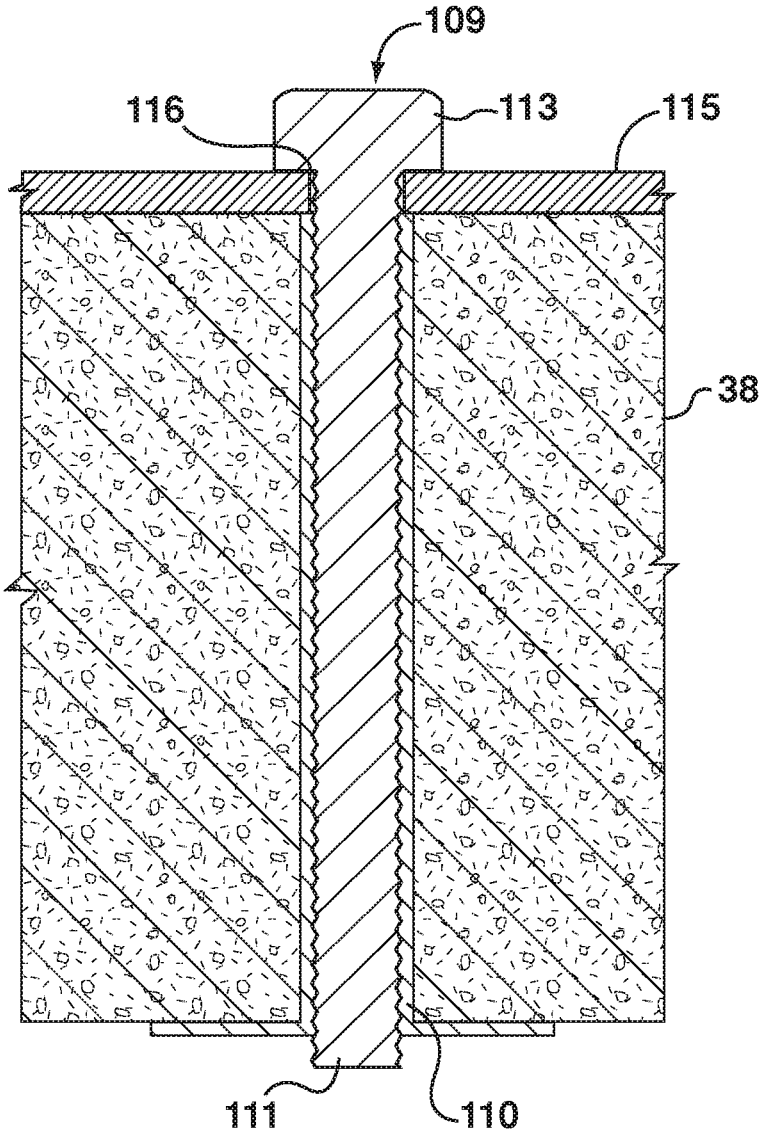
FIG. 6B is a cross-section of a portion of the mechanism of FIG. 6A secured to a panel subassembly, drawn at a larger scale.
Figure 6C:
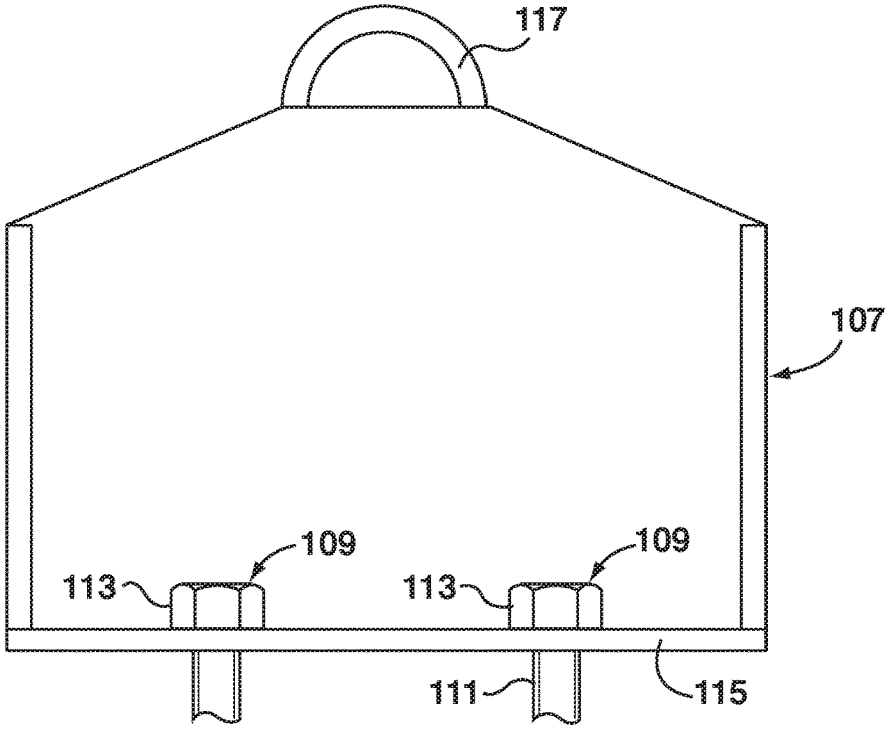
FIG. 6C is a front view of a bracket with fasteners therein.
Figure 6D:
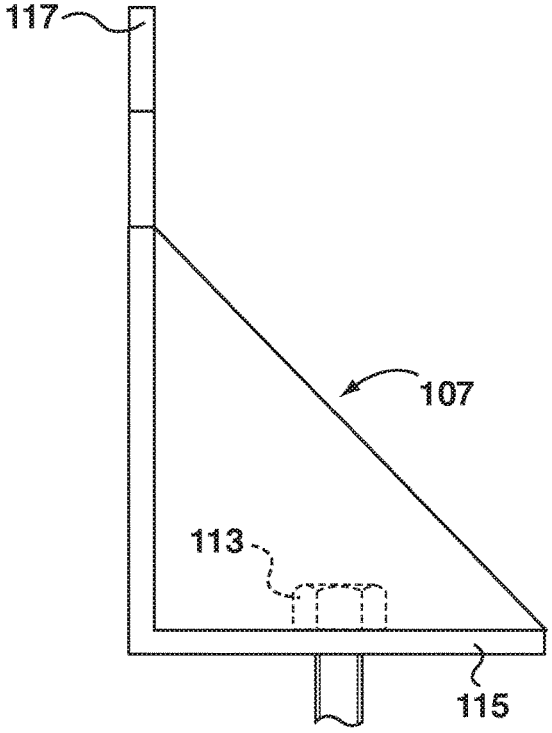
FIG. 6D is a side view of the bracket of FIG. 6C with fasteners therein.

In some examples, suitable threaded sleeves 110 are positioned in the upper concrete beam 38, when the panel subassembly is formed. Bolts 111 of the fasteners 109 are threadably engageable therein (FIG. 6B). The bracket 107 is positioned on the top surface 56 of the upper concrete beam 38 so that a hole 116 in a ledge 115 of the bracket 107 is aligned with the sleeve 110. Once secured, the bolts 111 are positioned so that heads 113 thereof, at their upper ends, engage the ledge 115 of the bracket 107. The bolt 111 is inserted into the sleeve 110 and tightened, to secure the bracket 107 to the upper concrete beam 38. The bolt 111 may be disengaged from the sleeve 110 when the bracket 107 is to be removed.

The bracket may include a loop element 117 to which a hook (not shown) or similar element connected to the crane is securable. The quick connection to, and disconnection from, the loop element of the bracket may be relatively convenient.

In use, the panel subassemblies are located at the building site utilizing the mechanism 105 therefor and a crane. In the case of a lowermost panel subassembly, the panel subassembly is positioned on the foundation so that threaded rods embedded in the foundation will extend through the lower beam in the lowermost panel subassembly, to enable the panel subassembly to be secured to the foundation. Each panel subassembly is, after being secured vertically to the foundation or the panel subassembly immediately below it and vertically abutting it, secured to the panel subassemblies abutting it laterally, using transverse connectors. Also, floor slabs are positioned on the panel subassemblies and secured thereto. As described above, additional panel subassemblies are positioned on ends of the floor slabs and secured thereto and to the lower panel subassemblies. From the foregoing, it will be understood that the systems and methods of the present disclosure may facilitate much faster construction of a building, resulting in significant cost savings.

While the above description provides examples of one or more processes or apparatuses, it will be appreciated that other processes or apparatuses may be within the scope of the accompanying claims.

I claim:

1. A method of erecting a building on a foundation, the method comprising:

providing a plurality of panel subassemblies, each panel subassembly comprising at least one column comprising a thermally-insulating material, and a concrete portion at least partially attached to the at least one column;

securing at least one of the panel subassemblies to the foundation;

lowering at least one of the panel subassemblies so that a threaded rod secured to the foundation is positioned in an aperture of the at least one of the panel subassemblies formed in a lower concrete beam thereof; and cutting an opening in the thermally-insulating material of the at least one of the panel subassemblies adjacent to the lower concrete beam.

2. The method of claim 1, comprising injecting grout to fill extra space in the aperture around the threaded rod.

3. The method of claim 2, comprising securing the at least one of the panel subassemblies to the threaded rod using a fastener.

4. The method of claim 3, comprising filling the opening with insulation material.

5. The method of claim 1, comprising securing a floor element of the building to a selected one of the panel subassemblies, so that the floor element is at least partially supported thereby.

6. The method of claim 5, comprising filling a gap between the floor element and a concrete exterior layer of the selected one of the panel subassemblies with material.

7. The method of claim 6, comprising positioning a threaded rod secured to the lowermost panel subassembly in an aperture of the floor element.

8. The method of claim 7, comprising securing the floor element to the threaded rod using a fastener.

9. The method of claim 5, comprising positioning a second panel subassembly on the floor element substantially vertically aligned with a lowermost panel subassembly, and securing the second panel subassembly and the lowermost panel subassembly together.

10. The method of claim 9, comprising positioning a threaded rod secured to the lowermost panel subassembly in an aperture of the floor element and an aperture of the second panel subassembly formed in a lower concrete beam thereof.

11. The method of claim 10, comprising cutting an opening in the thermally-insulating material of the second panel subassembly adjacent to the lower concrete beam.

12. The method of claim 11, comprising injecting grout to fill extra space in the apertures around the threaded rod.

13. The method of claim 12, comprising securing the second panel subassembly and the floor element to the threaded rod using a fastener.

14. The method of claim 13, comprising filling the opening with insulation material.

15. The method of claim 1, comprising transversely connecting two of the panel subassemblies together, and filling a gap formed between substantially abutting edges of the two of the panel subassemblies with grout.

16. The method of claim 15, comprising filling a stop pocket with the grout, the stop pocket formed by parallel portions and partially non-parallel portions of each of the edges.

17. The method of claim 15, comprising receiving a connector in at least one slot comprising a slot segment in each of the panel subassemblies, and encompassing the connector with the grout.

18. The method of claim 16, comprising receiving a connector in at least one slot comprising a slot segment in each of the panel subassemblies, and encompassing the connector with the grout.

19. A method of erecting a building, the method comprising:

providing a plurality of panel subassemblies, each panel subassembly comprising at least one column comprising a thermally-insulating material, and a concrete portion at least partially attached to the at least one column;

securing a floor element of the building to a selected one of the panel subassemblies, so that the floor element is at least partially supported thereby;

positioning a second panel subassembly on the floor element substantially vertically aligned with a lowermost panel subassembly, and securing the second panel subassembly and the lowermost panel subassembly together;

positioning a threaded rod secured to the lowermost panel subassembly in an aperture of the floor element and an aperture of the second panel subassembly formed in a lower concrete beam thereof; and cutting an opening in the thermally-insulating material of the second panel subassembly adjacent to the lower concrete beam;

injecting grout to fill extra space in the apertures around the threaded rod;

securing the second panel subassembly and the floor element to the threaded rod using a fastener; and filling the opening with insulation material.

20. A method of erecting a building on a foundation, the method comprising:

providing a plurality of panel subassemblies, each panel subassembly comprising at least one column comprising a thermally-insulating material, and a concrete portion at least partially attached to the at least one column;

lowering at least one of the panel subassemblies so that a threaded rod secured to the foundation is positioned in an aperture of the at least one of the panel subassemblies formed in a lower concrete beam thereof;

cutting an opening in the thermally-insulating material of the at least one of the panel subassemblies adjacent to the lower concrete beam;

injecting grout to fill extra space in the aperture around the threaded rod;

securing the at least one of the panel subassemblies to the threaded rod using a fastener; and filling the opening with insulation material.

* * * * *